United States Patent [19]

Ohkoshi et al.

[11] Patent Number: 4,734,623

[45] Date of Patent: Mar. 29, 1988

[54] FLUORESCENT DISPLAY APPARATUS

[75] Inventors: Akio Ohkoshi, Tokyo; Koji Tsuruta, Kanagawa; Kunio Shikakura; Hideaki Nakagawa, both of Tokyo, all of Japan

[73] Assignee: Sony Corporation, Tokyo, Japan

[21] Appl. No.: 83,891

[22] Filed: Aug. 6, 1987

Related U.S. Application Data

[63] Continuation of Ser. No. 901,788, Aug. 29, 1986, abandoned.

[30] Foreign Application Priority Data

Aug. 30, 1985 [JP] Japan ..... 60-191705

[51] Int. Cl.[4] ..... G06G 3/10

[52] U.S. Cl. ..... 315/169.4; 315/169.3; 313/497; 340/701; 340/719; 340/771

[58] Field of Search ..... 315/169.4, 169.3; 313/497; 340/701, 719, 771

[56] References Cited

U.S. PATENT DOCUMENTS 4,384,279 5/1983 Fujita ..... 340/815.2
4,413,257 11/1983 Kramer et al. ..... 340/815.2
4,613,794 9/1986 Oida ..... 340/781

*Primary Examiner*—Harold Dixon
*Attorney, Agent, or Firm*—Hill, Van Santen, Steadman & Simpson

[57] ABSTRACT

A fluorescent display apparatus includes display cells of a first type consisting of several sets of fluorescent display segments of various colors arranged in a certain order and display cells of a second type consisting of display segments equal in number and color, but opposite in the order of arrangement of colors, to the first display cells. The first and second display cells are arrayed in a matrix fashion with their lead lines aligning alternately with the intention of reducing areas used for the bend of lead lines and thereby arranging the cells closely so as to enhance the resolution of display.

6 Claims, 70 Drawing Figures

FLUORESCENT DISPLAY APPARATUS

This is a continuation of application Ser. No. 901,788, filed 8-29-86, now abandoned.

BACKGROUND OF THE INVENTION

1. Field of the Invention

The present invention relates to a fluorescent display apparatus including a large number of high-intensity light emitting display cells arranged in a 2-dimensional array.

2. Description of the Prior Art

There has been proposed a large-area display apparatus by the arrangement of numerous light emitting display cells each having "fluoresent trios" each made up of three fluorescent layers of red, green and blue, for example. Several light emitting display cells are assembled to form a unit, and many units are assembled to construct a large display screen.

There has been developed a light emitting display cell having several sets of fluorscent trios. This cell has on its one side a large number of leads for connection. When such cells are assembled to form a unit and many units are assembled in matrix to build a display unit, areas taken by the lead section of all cells become significantly large, restricting the layout density of cells.

SUMMARY OF THE INVENTION

Accordingly, it is an object of the present invention to provide a fluorescent display apparatus which reduces the area taken by the lead section and allows the layout of light emitting display cells without creating "dead spaces".

The present invention resides in a fluorescent display apparatus consisting of numerous high-intensity light emitting display cells arranged in a 2-dimensional array, wherein first display cells each made up of several fluorescent display segments in different colors arrayed in parallel to one another and second display cells each made up of fluorescent display segments equal in number and color to the first segments, but opposite in the arrangement of colors, are arrrayed with lead sections of both types of cells facing each other alternately in a matrix fashion, thereby eliminating useless dead spaces.

In one aspect of this invention, the display apparatus includes first display cells 71A each made up of several sets of fluorescent display segments in different colors, e.g., green 14G, red 14R and blue 14B, arranged in parallel, and second display cells 71B each made up of fluorescent display segments equal in number and color to the first cells, but opposite in the arrangement of each set, 14B, 14R and 14G, as shown in FIG. 55 A, B. Both types of cells 71A and 71B have their lead sections 100 located on the same side of the cells, but positioned such that the leads 100 of 71A and the leads 100 of 71B are arranged alternately when both cells are placed with their lead sections 100 facing each other. The cells 71A and 71B are each integrated in pairs to form display tude blocks 134A and 134B, respectively. Both types of cells 71A and 71B, i.e., display tube blocks 134A and 134B, are arrayed in a matrix fashion on a unit panel 151 such that their lead sections 100 face each other and each lead of one block is positioned between leads of another block as shown in FIG. 50. A number of units each arranged as described above are assembled in a matrix fashion to construct a display screen.

The display cells are placed in an insulation chassis 11, and several sets of electrode units 13 (or 90) are disposed confronting the sets of fluorescent display segments so that each electrode unit projects an electron beam on to a corresponding display segment to make it luminous. Each electrode unit 13 (or 90) consists of three electron beam sources, i.e., three wire cathodes K and first grids (control grids) G1 in correspondence to a set of fluorescent display segments, i.e., the fluorescent trio 12, and a common second grid (acceleration grid) G2 which is also partly served by a unit chassis 26, all integrated in a unitary member. The display cells can be those 71 and 71' incorporating several sets of fluorescent trios, as shown in FIGS. 1 and 2 or FIGS. 34 and 35.

Since the first cells 71A and second cells 71B are arranged in a matrix fashion with their lead sections 100 facing each other and the leads aligning alternately, the unit 166 need not have a lead section on its side. Also inside the unit, the leads of both cells are positioned alternately, saving the space for bending the leads 100.

DESCRIPTION OF THE PREFERRED EMBODIMENTS

The present invention will now be described in detail with reference to the drawings.

Figure 1:
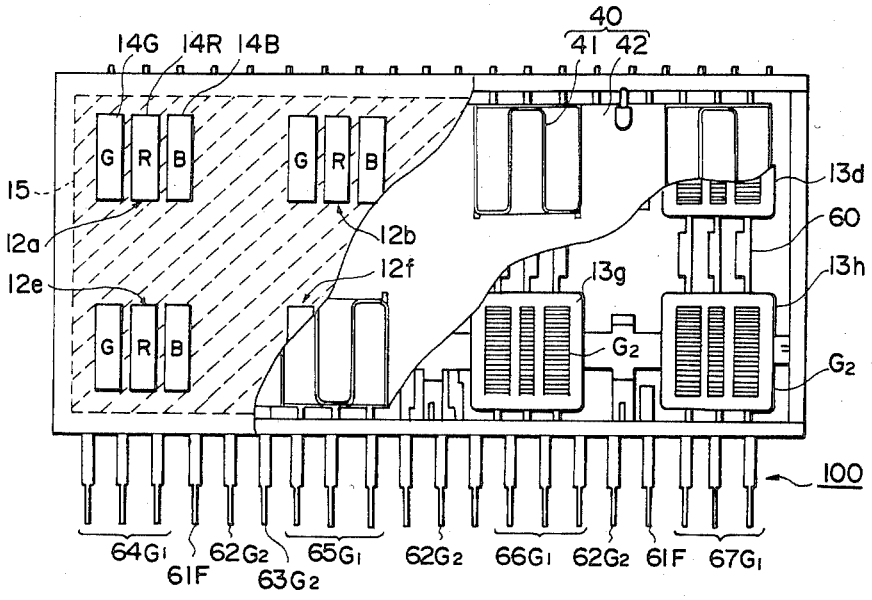
FIGS. 1 and 2 are partly cross-sectional front and side views of the fluorescent display apparatus embodying the present invention.
Figure 2:
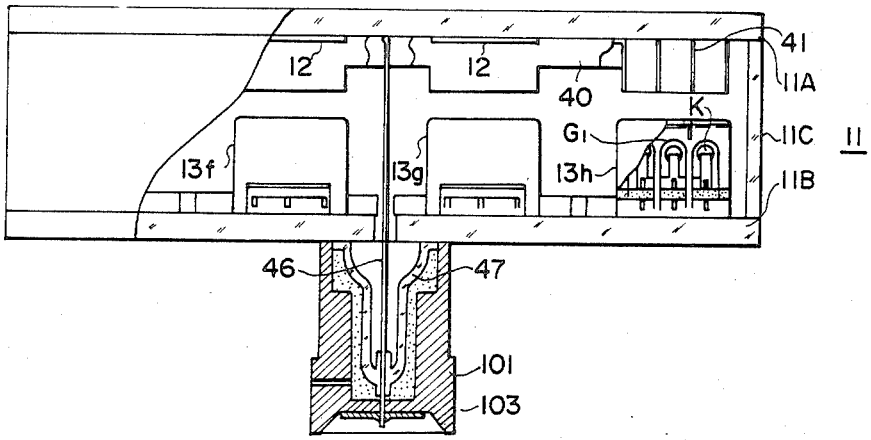
Figure 3:
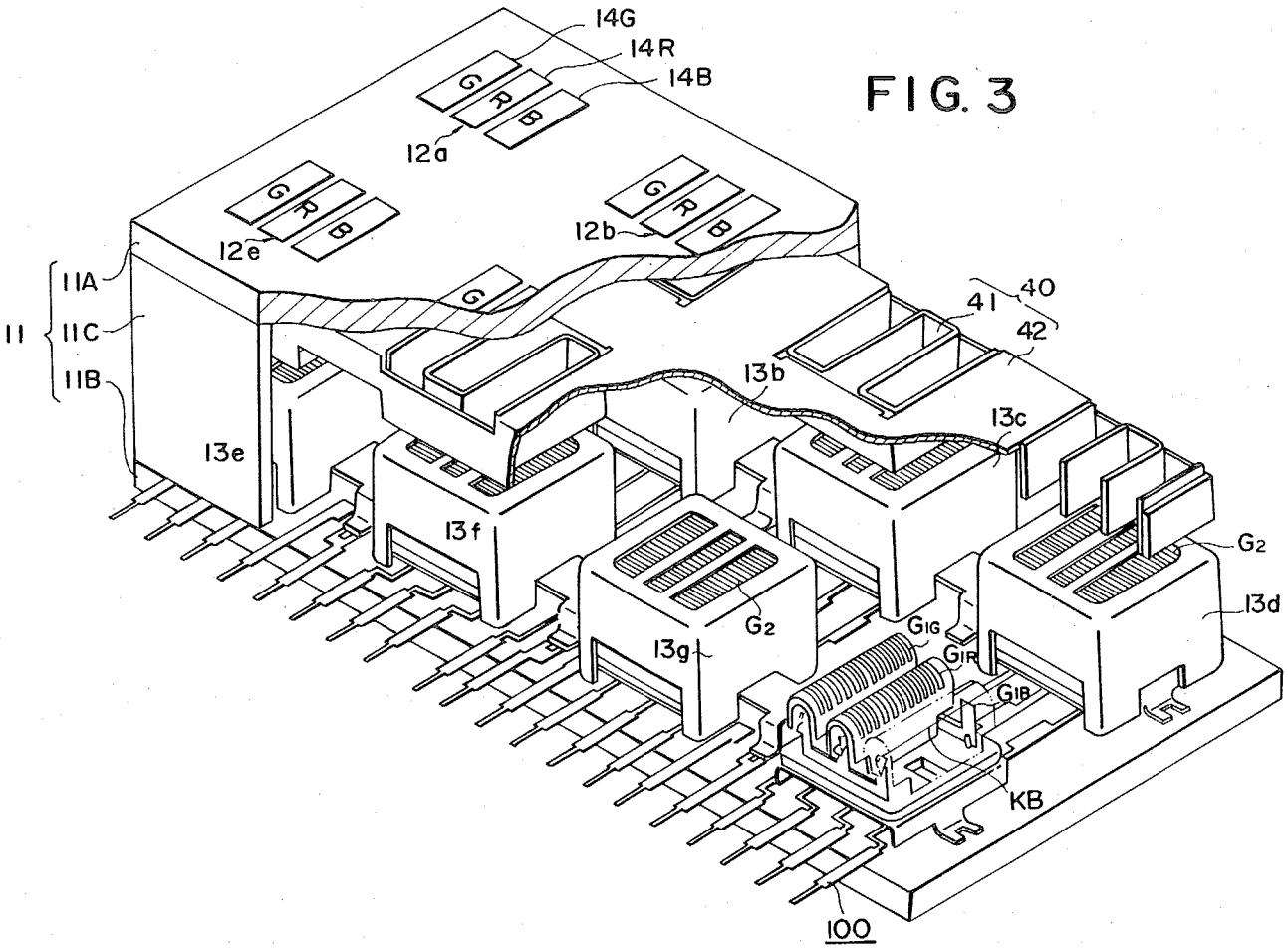
FIG. 3 is a perspective view partially broken away showing the structure of the embodiment.

FIGS. 1, 2 and 3 are front view, side view and perspective view partially broken away showing the inventive fluorescent display tube which constitutes a unit display cell. In the figures, a glass casing 11 consists of a front panel 11A, rear panel 11B and side boards 11C. The blass casing 11 has dimensions of 41 mm longitudinally by 86 mm laterally, for example, for the front panel 11A. Disposed inside the glass casing 11 are several sets of fluorescent layers forming pixels, namely in this embodiment eight sets of fluorescent trios 12, (12*a*, 12*b*, 12*c*, 12*d*, 12*e*, 12*f*, 12*g*, 12*h*) and eight sets of electrode units 13 (13*a*, 13*b*, 13*c*, 13*d*, 13*e*, 13*f*, 13*g*, 13*h*) confronting the respective fluorescent trios 12.

Figure 8:
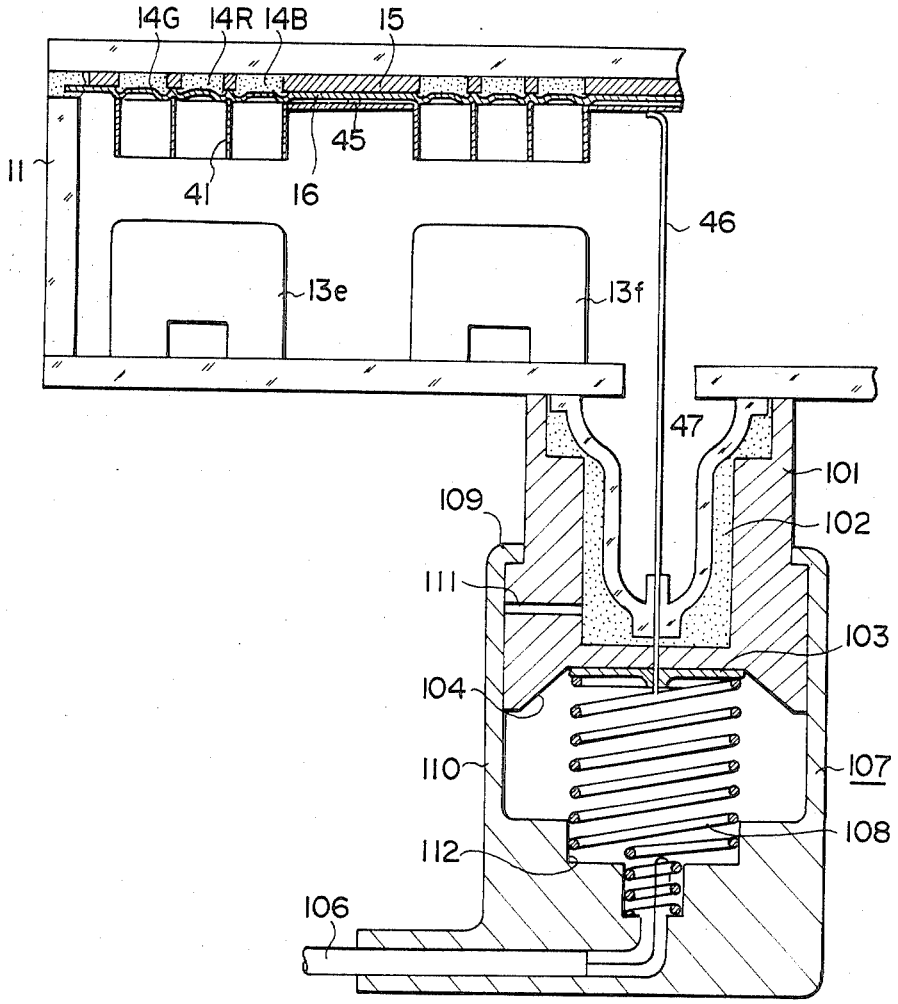
FIG. 8 is a cross-sectional view showing in detail the principal portion of FIG. 2.
Figure 13:
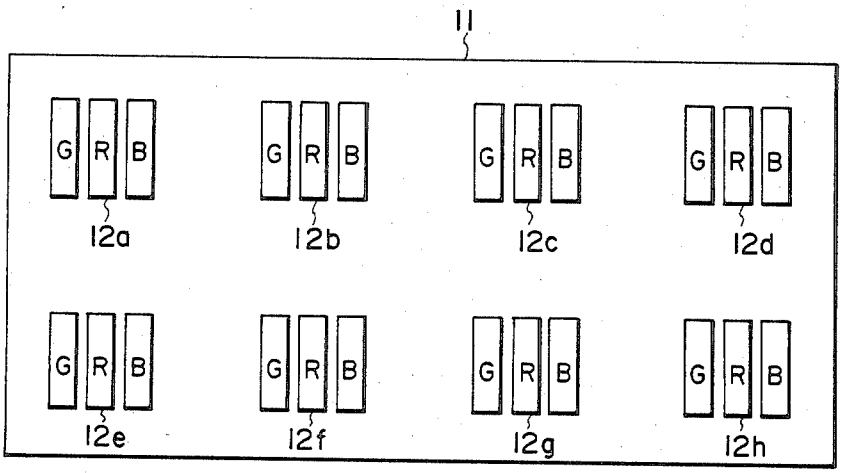
FIG. 13 is a plan view showing the layout of fluorescent trios.
Figure 14:
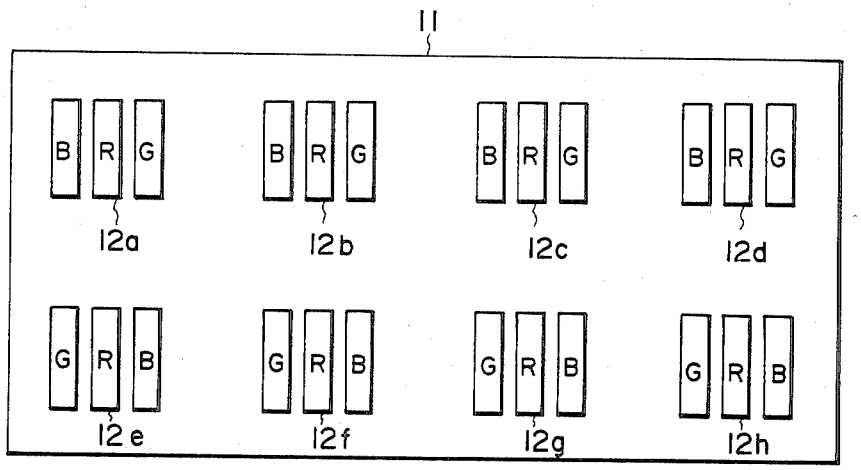
FIG. 14 is a plan view showing another layout of fluorescent trios.

The eight sets of fluorescent trios 12 are formed by coating fluorescent layers on the inner surface of the front panel 11A, four sets layers aligning on the upper row and four sets of layers on the lower row, each fluorescent trio 12 being made up of three layers of display segments 14R, 14G and 14B emitting light in red, green and blue, respectively. The detailed structure of the fluorescent display tube is shown in FIG. 8, in which a frame of conductive carbn layer 15 is printed on the inner surface of the front panel 11A, a red fluorescent layer 14R, green fluorescent layer 14G and blue fluorescent layer 14B are printed in the respective areas in the frame so that these layers partly overlie the carbon layer 15, and a metallic back layer 16 made of aluminum, for example, is coated through an intermediate film on its front surface. In the fluorescent trio 12, the red fluorescent layer 14R is placed at the center, and the green and blue fluorescent layers 14G and 14B are placed on both sides of 14R, and the same fluorescent trios are lined up in two rows as shown in FIG. 13. Alternatively, the green fluorescent layer 14G and blue fluorescent layer 14B may be transposed for one of rows as shown in FIG. 14.

Confronting the fluorescent trios 12, the electrode units 13 are disposed correspondingly on the side of the rear panel 11B. The electrode unit 13 consists of three wire cathodes K (KR, KG, KB) and confronting three first grids G1 (G1R, G1G, G1G) in positions coincident with the red, green and blue fluorescent layers 14R, 14G and 14B, respectively, and a second grid G2 commonly serving the three first grid G1.

Figure 4:
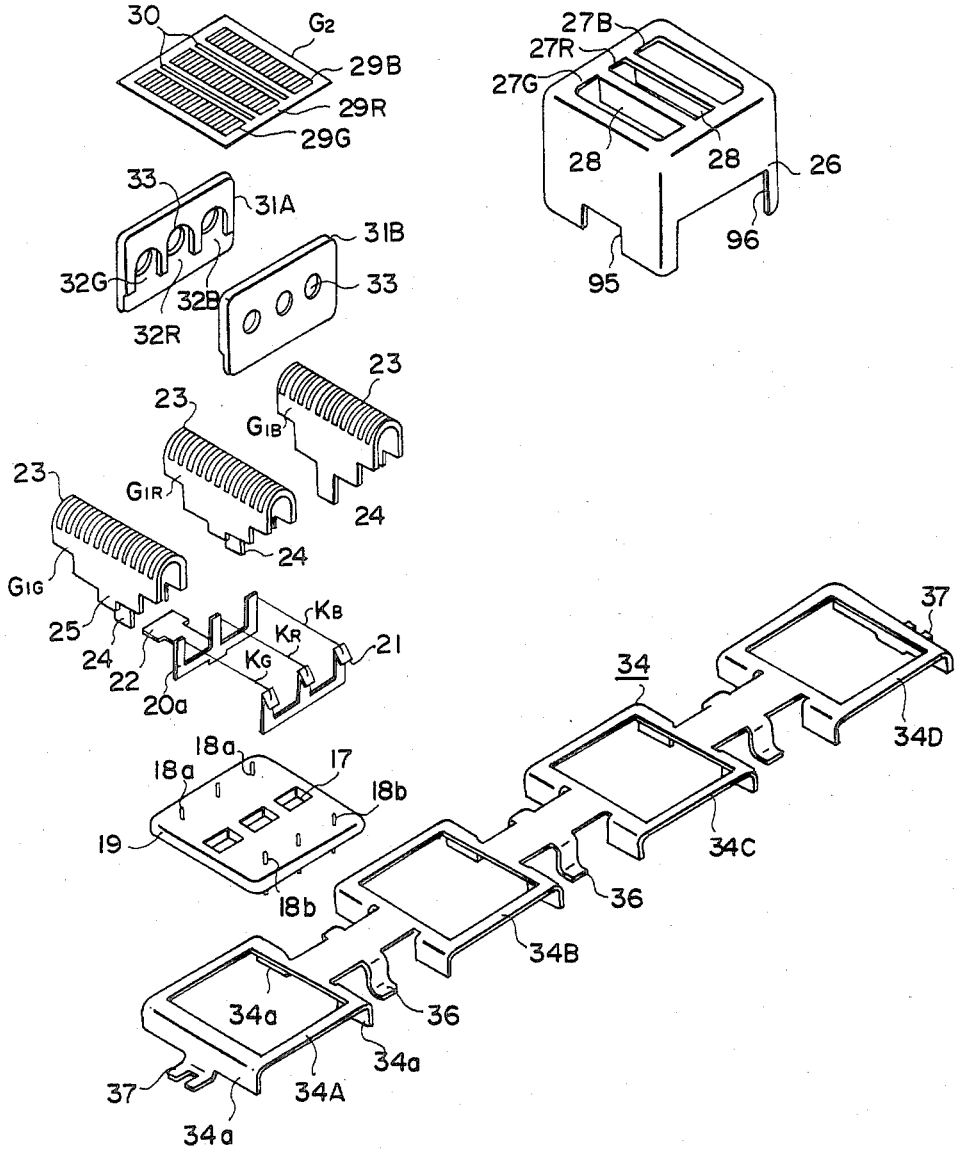
FIG. 4 is a set of perspective views showing the assembly components of the electrode unit.

The detailed assembly of the electrode unit 13 is shown in FIGS. 4 through 7. In FIG. 4, an insulation substrate, e.g., ceramic base, 19 is planted thereon terminal pins 18*a* and 18*b* lining up in pairs on both sides of a series of three rectangular openings. The two sets of three in-line pins 18*a* and 18*b* are provided thereon by spot welding E-shape conductive lugs 20*a* and 20*b*, respectively, and wire cathodes KG, KR and KB are pitched between the corresponding ends of the conductive lugs 20*a* and 20*b*. One lug 20*a* serves to fix one end of the wire cathodes K, while the other lug 20*b* has bent spring sections 21 on which the other end of the wire cathodes K is fixed so that the wire cathodes K are kept tight by the spring action, should the wire cathodes expand due to a temperature rise. The lug 20*a* is provided with a lead-out terminal 22. Each wire cathode K is made of a tungsten heater wire with application to its surface of carbonate for example, as an electron emitting substance.

Next, the first grids G1G, G1R and G1B are supported in the openings 17 of the ceramic base 19. Each first grid G1 is formed in a hemi-cylindrical shape with its arc section confronting a corresponding wire cathode K. The cylindrical surface is provided in the longitudinal direction with numerous slits 23 at a certain interval, and its open ends have a shape to form feet 24 and 25 in width virtually equal to the width of the openings 17. The feet 24 and 25 are inserted into the openings 17 of the ceramic base 19 by being made close to each other, so that the first grid G1 is press fitted by the spring action of the feet in the opening 17. One foot 24 is made longer so that it is used as a terminal, while another foot 25 is made shorter, and therefore the longer foot 24 extends through the opening 17 and the shorter foot 25 ends within the opening 17.

The electrode unit is provided with a conductive casing 26, which forms part of the second grid G2. The casing 26 has in its front face three openings 27 (27G, 27R, 27B) each confronting a corresponding first grid G1, and is provided with separators 28 which extend inwardly so as to isolate the openings 27 from one another. The casing 26 is manufactured by drawing and barrel polishing so that it is inert in discharging. The common second grid G2 is disposed in the casing 26. The second grid G2 has the formation of slit meshes 29G, 29R and 29B in positions coincident with the first grids G1G, G1R and G1B, with the slits of the second grids being coincident with the slits 23 of the respective first grids G1. Formed between adjacent meshes 29 are grooves 30, in which the separators 30 run through. The second grid G2 is placed in the casing 26, with its meshes 29G, 29R and 29B facing the respective openings 27G, 27R and 27B of the casing and with its grooves 30 coupling with the separators 28. The second grid G2 is spot welded to the casing 26 so that both members are connected mechanically and electrically, and therefore the casing 26 also functions as part of the second grid.

Next, a pair of insulation separators 31A and 31B are inserted along the confronting interior walls of the casing 26. The separators 31A and 31B are provided in their inner sides with three grooves 32 (32G, 32R, 32B) for receiving both ends of the first grid G1. Each groove 32 has a through-hole 33. The separators 31A and 31B are held in the casing 26 by being clamped between the wall of the casing 26 and the separators 28. The top of the separators 31A and 31B is in contact with the second grid G2.

After assembling the second grid G2 and separators 31A and 31B in the casing 26, the ceramic base 17 on which the wire cathodes K and first grids G1 are mounted is inserted in the casing 26 such that the rear end of the separators 31A and 31B comes in contact with the base surface. At the same time, both ends of the first grids G1G, G1R and G1B fit in the grooves 32G, 32R and 32B of the separators 31A and 31B. Accordingly, each first grid G1 is positioned accurately by being clamped at its feet 24 and 25 in the openings 17 of the ceramic base 19 and at its both ends in the grooves 32 of the separators 31A and 31B.

The wire cathode lug 20*a* has its extended terminal 22 led out through the gap between the ceramic base 19 and separator 31*a* and through the cut formed in the casing 26 to the outside.

Figure 5:
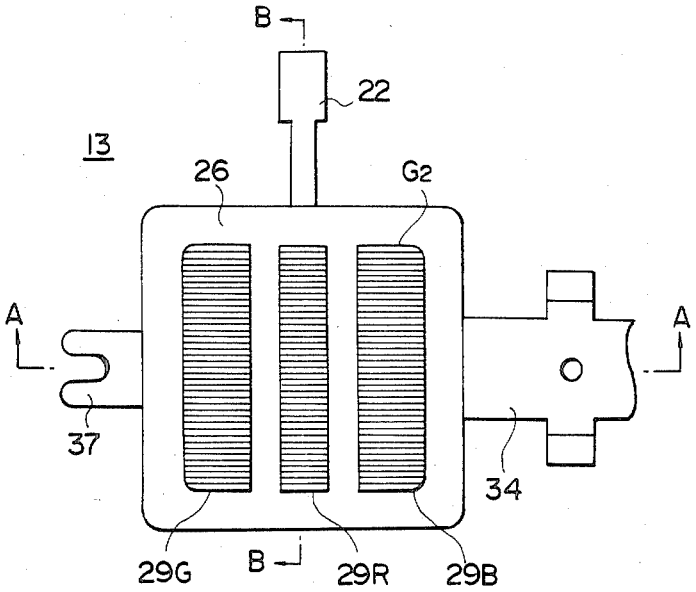
FIG. 5 is a plan view of the electrode unit.
Figure 6:
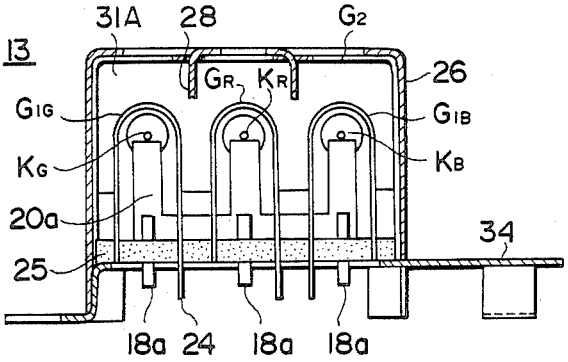
FIG. 6 is a cross-sectional view taken along the line A—A of FIG. 5.
Figure 7:
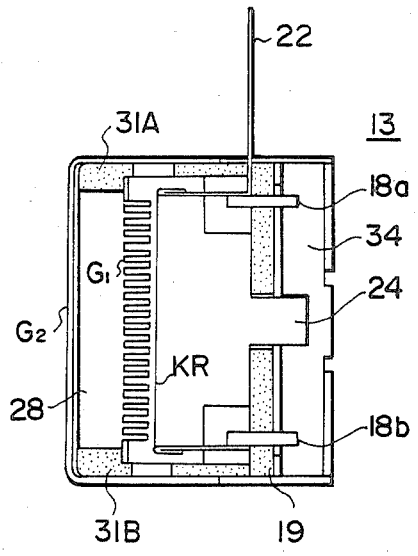
FIG. 7 is a cross-sectional view taken along the line B—B of FIG. 5.

In a retainer chassis 34 made of conductive material, a frame-shape retainer 34A is coupled with the casing 26 and its bend 34*a* is spot welded to the casing 26, and the electrode unit 13 shown in FIGS. 5, 6 and 7 is completed.

The conductive retainer chassis 34 consists of four retainers 34A, 34B, 34C and 34D linked in series by conductive bridges 35 to form a unitary member as shown in FIG. 4, and each bridge engages with the cut 95 of the casing 26 when the retainers 34 are coupled with the four electrode unit casings 26. The bridge 35 has tabs 36 to be spot welded to the lead frame (not shown) and another tabs 37 to be secured to the glass casing 11. Accordingly, the second grids G2 of the four electrode units 13 are connected together electrically through the conductive retainer chassis 34.

Figures 12, 15:
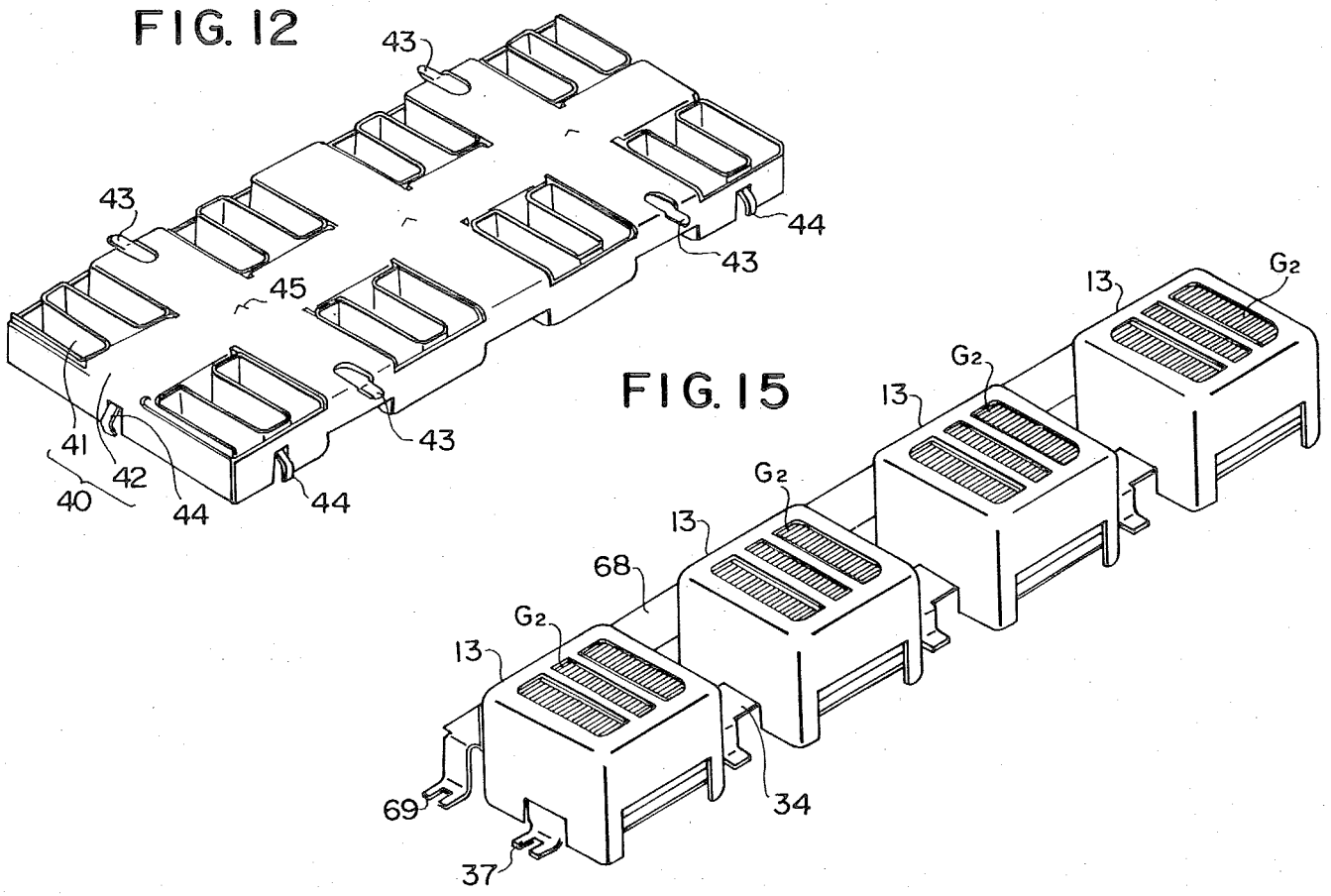
FIG. 12 is a perspective view showing the separator body on the part of the anode.
FIG. 15 is a perspective view showing another embodiment of the electrode unit section arranged in a serial connection of units.

There is disposed a separator chassis 40 made of conductive material, as shown in FIG. 12, to surround each set of fluorescent layers 14R, 14G and 14B of the eight fluorescent trios 12. The separator chassis 40 serves as a shield for preventing electron beams coming from the wire cathodes from hitting the first grids G1 and second grids G2 to generate secondary electrons which would illuminate adjacent fluorescent layers, as a divergent lens for widening the electron beams from the wire cathodes K to project on to the entire areas of the respective fluorescent layers 14, and as a power delivery means for applying high-voltage power, e.g., 8 kV, to the fluorescent trios 12. The separator chassis 40 is held between the front panel 11A and side boards 11C of the glass casing 11 and fixed by use of frit glass at the time of assembling. Namely, the separator chassis 40 has three separator compartments 41 for surrounding three fluorescent layers of each fluorescent trio 12, and eight sets of separator compartments 41 are connected by an electrode plate 42 to form a unitary member with supporting hooks 43 extending outward being formed at the top of the chassis. The separator chassis 40 is provided on its sides with bent tabs 44 used for positioning the chassis. On this account, when the separator chassis 40 is put into the glass casing 11 from the above, the supporting hooks 43 come to contact with the side boards 11C at the top to support the separator chassis 40, and at the same time the bent tabs 44 come to contact with the inner walls of the side boards 11C to settle the separator chassis 40 at the right position. The separator chassis 40 is further provided with protrusions 45 in positions facing the electrode plate (see FIG. 8), and the protrusions 45 is exactly in contact with the metallic back layer 16 or carbon layer 15 when the separator chassis 40 is fitted to the side boards 11C and the front panel 11A is placed on the side boards 11C to close the casing. Through this contact, the high-voltage power received at the high voltage terminal, i.e., anode lead 46, is supplied commonly to all fluorescent trios 12. The anode lead 46 for receiving the high-voltage power has its one end connected to the electrode plate 42 of the separator chassis 40 and another end routed to the outside through an evacuation tube (tip-off tube) 47 fixed on the rear panel 11B of the glass casing 11, as shown in FIG. 8. The anode lead 46 uses a dumet line (Cu arroy) wound on a section of the evacuation tube 47, and therefore the hermetic sealing between the anode lead 46 and evacuation tube 47 is ensured.

Figure 9:
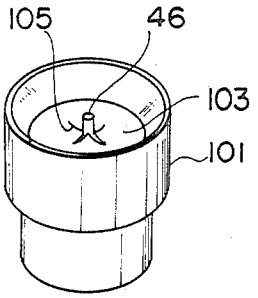
FIG. 9 is a perspective view of the anode lead section.

The evacuation tube 47 is covered externally with a mechanically protective high-voltage insulator 101 through a resin mold material (adhesive) 102, and the anode lead 46 is connected electrically to a high-voltage terminal washer 103 provided at the end of the insulation cylinder 101. The terminal washer 103 is placed in a recess 104 formed at the end of the insulation cylinder 101, and the anode lead 46 is press fitted to the center of a cross cut 105 formed at the center of the washer 103, thereby allowing the anode lead 46 to connect electrically to the terminal washer 103 without the need of soldering (see FIG. 9). A connector means (socket) 107 in connection with the external high-voltage lead 106 from a high-voltage power source (described later) is coupled to the insulation cylinder, the external lead 106 is connected through a spring 108 to the terminal washer 103, and the anode voltage is supplied to the anode lead 46. The connector means 107 consists of a spring which is in connection with the external high-voltage lead 106 and an insulator cap 110 made of silicon rubber, for example, having a coupling section 109 fitted to the outside of the insulation cylinder 101. An insulator cap 110 is fitted detachably to the insulator cylinder 101, and it serves to protect and insulate the spring 108. The insulation cylinder 101 has an air hole 111 provided for fostering the hardening of the resin mold material 102. The insulation cylinder 101 has a recess 104 in which the washer 103 is placed, and it flares out longitudinally so that the spring 108 comes in close contact with the washer 103 by being guided along the tapered wall of the recess. On the part of the connector means 107, another end of the spring 108 is positioned to a small recess 112 formed in the cap 110. In this structure, the evacuation tube 47 with the accompanied anode lead 46 is protected mechanically by the insulation cylinder 101, whereby the easy-collapsing evacuation tube 47 is prevented from being damaged when the external high-voltage lead 106 is connected. Electrical connection between the anode lead 46 and external lead 106 is made through the contact of the spring 108 to the terminal washer 103, which relieve the direct load to the anode lead 46.

Figure 10:
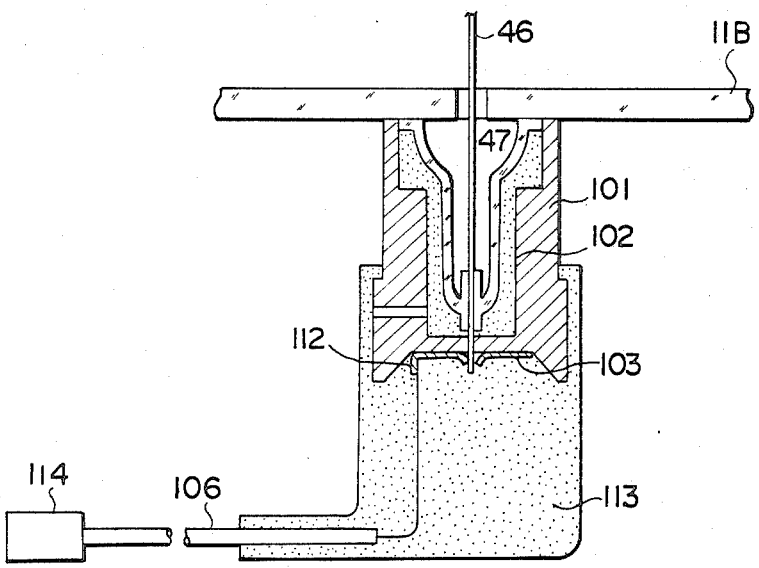
FIGS. 10 and 11 are cross-sectional views showing examples of connection between the anode lead and external lead.
Figure 11:
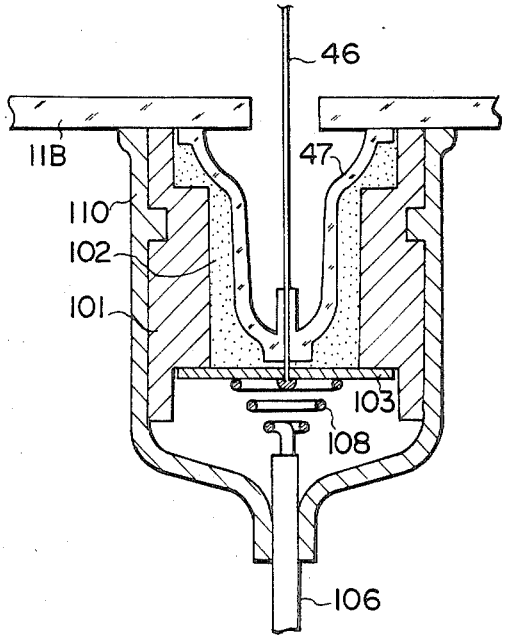

FIG. 10 shows another way of anode lead connection, in which the terminal washer 103 has in its outer edge a stand section 112 to which the external lead 106 is soldered directly, with the connection and the insulation cylinder 101 being covered by the resin mold member 113. In this case, the external lead 106 is provided on its end a socket 114 for connection to the high-voltage power source. Still another arrangement is shown in FIG. 11, in which the anode lead 46 is soldered to the terminal washer 103 and the external lead 106 is connected detachably to the terminal washer 103 through a spring 108.

On the part of the electrode units 13, after four units 13*a*–13*d* have been mounted on each of two retainer chassis 34, the two assemblies including eight electrode units 13 are placed in the specified position on the lead frame 60, and the fixing tabs 36 of the retainer chassis 34 are spot welded to the lead frame 60. Thereafter, connection is made between retainer chassis 34 on the side of the terminal pins 18 of the wire cathodes K and the feet 24 of the first grids G1 and the corresponding leads on the lead frame using lead wires, for example, (not shown). In this case, the second grids G2 of four lateral in-line electrode units 13*a*–13*d* and the second grids G2 of four lateral in-line electrode units 13*e*–13*h* are connected in groups by the respective retainer chassis 34. The first grids G1 of two longitudinal in-line electrode units 13*a* and 13*e*, those of units 13*b* and 3*f*, those of units 13*c* and 13*g*, and those of units 13*d* and 13*h* are connected in groups. Namely, among the longitudinally arrayed electrode units, the central G1Rs are connected together, the rightmost G1Bs are connected together, and the leftmost G1Gs are connected together. The wire cathodes K of all electrode units are connected in series in this embodiment. In the case of reversing the order of green fluorescent layer 14G and blue fluorescent layer 14B in the fluorescent trios 12 between two rows (FIG. 14), the central G1Rs are connected together, the rightmost G1B and G1G are connected together, and the leftmost G1G and G1B are connected together. The leads of the wire cathodes K, first grids G1 and second grids G2 are led out to the outside from one side of the glass casing 11 through a seal provided between the rear panel 11B and side board 11C. Namely, leads 61F are for the connection of the wire cathodes, leads 62G2 are for the common connection of the second grids G2 among the electrode units 13*e*–13*h*, leads 63G2 are for the common connection of the second grids G2 among the units 13*a*–13*d*, leads 64G1 are for the common connection of the three first grids G1 between the unit 13*a* and 13*e*, leads 65G1 are for the common connection of three first grids G1 between the units 13*b* and 13*f*, leads 66G1 are for the common connection of three first grids G1 between the unit 13*c* and 13*g*, and leads 67G1 are for the common connection of three first grids G1 between the units 13*d* and 13*h*. The number of leads coming out of the glass casing 11 is determined appropriately to meet the design requirement.

Figure 16:
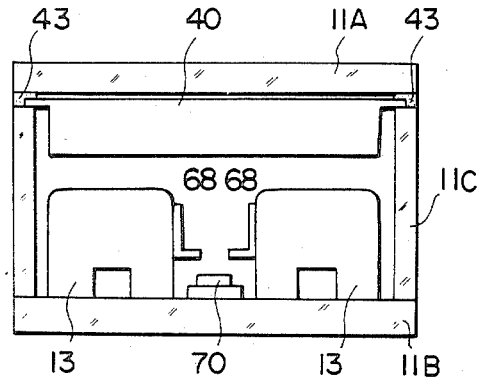
FIG. 16 is a cross-sectional view showing the disposition of the getter container.

The electrode units 13*a*–13*d* and 13*e*–13*h* mounted on the respective retainer chassis 34 are fixed in such a way of clamping the lags 37 on both ends of the retainer chassis 34 between the rear panel 11B and side boards 11C when the glass casing 11 is sealed. In order to prevent the displacement of the electrode units caused by warping or bending or the retainer chassis 34, which might occur due to the support for the four electrode units only at both ends, it is also possible to provide an L-shape reinforcement member 68 integrated commonly on the side of four electrode units, as shown in FIG. 15, with its both ends being fixed through tabs 69 between the rear panel 11B and side boards 11C. The reinforcement member 68 is made of a conductive material. The reinforcement member 68 helps prevent warping and slanting of the retainer chassis 34, whereby the electrode units 13 is prevented from displacement. The reinforcement member 68 also serves to reduce the dispersion of getter particles from the getter container 70 toward the fluorescent screen as shown in FIG. 16. The reinforcement member 68 further has a discharge preventive function by being applied with the same potential as of the second grid G2. Namely, the reinforcement member 68 prevents the anode electride field from soaking to a low-voltage section, and discharging between the separator chassis 40 to which the anode voltage is applied and the leads of the lower voltage grids G1 and G2 and cathodes K is avoided.

Next, the operation of the foregoing display cells will be described. An anode voltage of around 8 kV, for example, is supplied through the anode lead 46 to the red, green and blue fluorescent layers 14R, 14G and 14B of each fluorescent trio 12. A voltage ranging 0–5 volts or lower, for example, is applied to the first grids G1R, G1G and G1B, while another voltage ranging—15 to 50 volts, for example, (row selection voltage) is applied to the second grid G2. In this embodiment, the anode voltage is fixed, a row is selected by the voltage applied to the second grid G2, and a fluorescent trio is activated selectively by application of the voltage to the first grid G1. For example, with 50 volts applied to the second grid G2 of the electrode units 13*a*–13*d* on the upper row and with a cutoff voltage, e.g., −15 volts, applied to the second grid G2 on the lower row, when a voltage, e.g., 5 volts, is applied to the first grid G1 through the lead 64G1, the first fluorescent trio 12*a* is selected, and the electron beam emitted from the cathodes K of that electrode unit are introduced through the first grids G1 and accelerated by the second grid G2 onto the associated fluorescent layers 14R, 14G and 14B for illumination. By controlling the pulse width (application time length) of the first grid voltage (5 V), the intensity of illumination is controlled.

When the first grids G1 are brought to zero volt, the electron beams from the cathodes are cut off, and corresponding fluorescent layers are deactivated. Through the application of the voltage to the first grids G1 sequentially through the leads 64G1, 65G1, 66G1 and 67G1, the fluorescent trios 12*a*–12*d* on the upper row are activated, and subsequently by switching the second grid voltage (50 V) to the second grids G2 of the lower row and through the application of the first grid voltage through the leads 64G1–67G1 sequentially, the fluorescent trios 12*e*–12*h* on the lower row are activated.

The electron beam emitted from the wire cathode K is diverged by the action of the first grid G1 and separator 41, and projected on to the entire area of the fluorescent layer 14. The electron beam form the wire cathode K may hit the first grid G1 and second grid G2, causing the generation of secondary electrons on these grids, but these secondary electrons are blocked by the separator 28 on the casing 26 of the second grid and the separator 41 of the anode, and therefore do not reach the adjacent fluorescent layers. In this manner, by controlling the first grid voltage and second grid voltage selectively, each of the fluorescent trios 12 is activated to illuminate sequentially.

The fluorescent cell 71 is constructed by densely arranging eight pixels, i.e., fluorescent trios 12 in one cell, making it compact as the whole.

The three wire cathodes K and first grids G1 and a common second grid G2 are assembled in a unit with its casing 26 also serving as the second grid G2, and such electrode units are arranged in correspondence to the fluorescent trios 12, thereby facilitating the fabricating process of the display cell 71. The unit casing 26 is manufactured by drawing work, resulting in a round corner of structure, which effectively raise the discharge withstanding voltage and eventually prevents failures caused by discharging.

In the electrode unit 13, the first girds G1 are positioned and supported without using spot welding or the like, but by means of the operating 17 formed in the ceramic base 19 and the grooves 32 formed in the insulation separators 31A and 31B, whereby the assembled electrode unit 13 can be made sufficiently compact.

When a large number of display cells 71 are arrayed to form a large display screen, fluorescent trios 12 are disposed in the same interval longitudinally and laterally on a plane, with little space being allowed between adjacent cells 71. However, each cell 71 has its anode lead 46 led out through the evacuation tube 47 at the rear panel 11B of the glass casing 11, and therefore adjoining cells 71 can be closely located.

Each of the eight fluorescent trios 12 includes a red fluorescent layer 14R located at the center and a green and blue fluorescent layers 14G and 14B are transposed for the upper or lower row, the apparent resolution can be enhanced.

Figure 18:
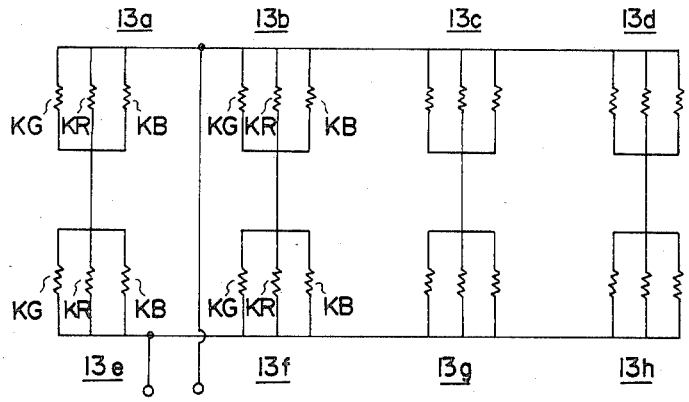
FIG. 18 is a schematic diagram showing another example of cathode connection.

In the above embodiment, the eight sets of electrode units 13 have their cathodes K connected together directly, but alternatively they may be connected in parallel as shown, for example, in FIG. 18, and in this case a broken wire cathode of one electrode unit does not precludes the operation of other electrode units.

It is possible to connect the terminals of the electrode units to the lead frame without using lead wires, but by the direct connection between them. Particularly, for the wire cathodes K, the terminal 22 on the supporting tab 20*a* is bent and extended to the lead frame for direct connection.

Figure 19:
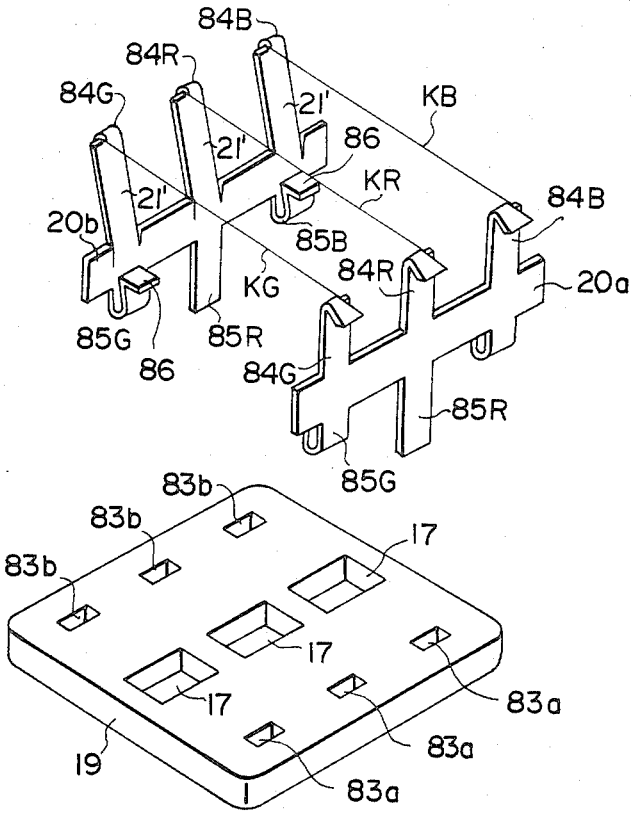
FIGS. 19 and 20 are perspective view and cross-sectional view showing another example of the wire cathode support structure in the electrode unit.
Figure 20:
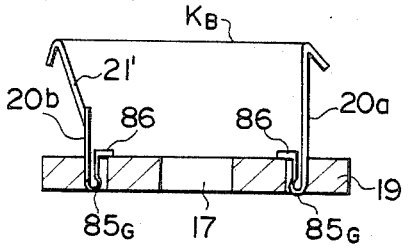

In the foregoing arrangement of the electrode unit 13, the terminal pins 18*a* and 18*b* are planted on the ceramic base 19, but the arrangement with the terminal pins 18*a* and 18*b* being omitted is also possible as shown in FIGS. 19 and 20. In these figures, the ceramic base 19 is provided with the formation of conductive lugs 20*a* and 20*b* and their supporting through-holes 83*a* and 83*b* on both sides of each opening 17. The conductive lug pairs 20*a* and 20*b* have their wire cathode attachment sections 84G, 84R and 84B connected together, with the central lug end 85R being elongated to become a lead and other lug ends 85G and 85B being bent to become elastic. The cathode attachments 84G, 84R and 84B of one conductive lugs 20*a* are formed rigid, while those of another conductive lugs 20*b* are formed with cuts at their root so that they function as springs 21' as the whole. The conductive lugs 20*a* and 20*b* are provided with sections 86 so that they keep standing upright. The end of the lugs 84G, 84R and 84B, where the wire cathodes KB KR and KG are attached, is bend with the formation of a cut so as to allow centering for the wire cathode K. The lugs 20*a* and 20*b* are inserted in the through-holes 83*a* and 83*b* so that they are supported on the ceramic base 19 by the bend end sections 85G and 85B, and thereafter the wire cathodes KG, KR and kB are strung between both lugs 20*a* and 20*b*. The leads 85R of both lugs are led out to the other side of the ceramic base 19. In this arrangement, the terminal pins 18*a* and 18*b* can be eliminated, and the parts count of the electrode unit 13 can be reduced.

Figure 21:
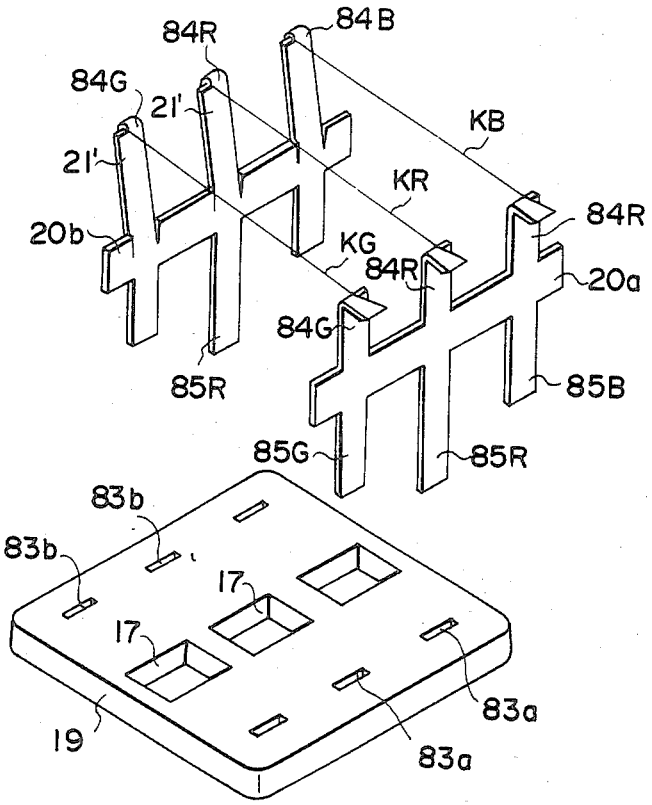
FIGS. 21 and 22 are perspective view and cross-sectional view showing another example of the wire cathode support structure in the electrode unit.
Figure 22:
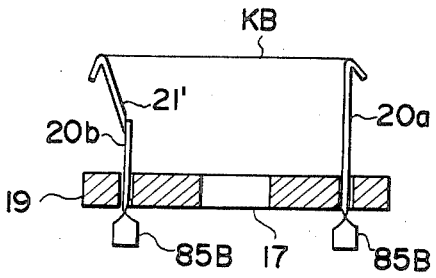

FIGS. 21 and 22 show another embodiment of the conductive lugs 20*a* and 20*b* for stringing the wire cathodes K. In this example, the lugs 84G and 84B located at both sides have their ends 85G and 85B formed straight without being bent, with the remaining portion formed identically to the case of FIG. 19. The conductive lugs 20*a* and 20*b* are inserted in the through-holes 83*a* and 83*b* in the ceramic base 19, with their ends 85G and 85B on another side of the base 19 being twisted by about 90° as shown in FIG. 22, and they can easily be secured to the ceramic base 19.

Figure 23:
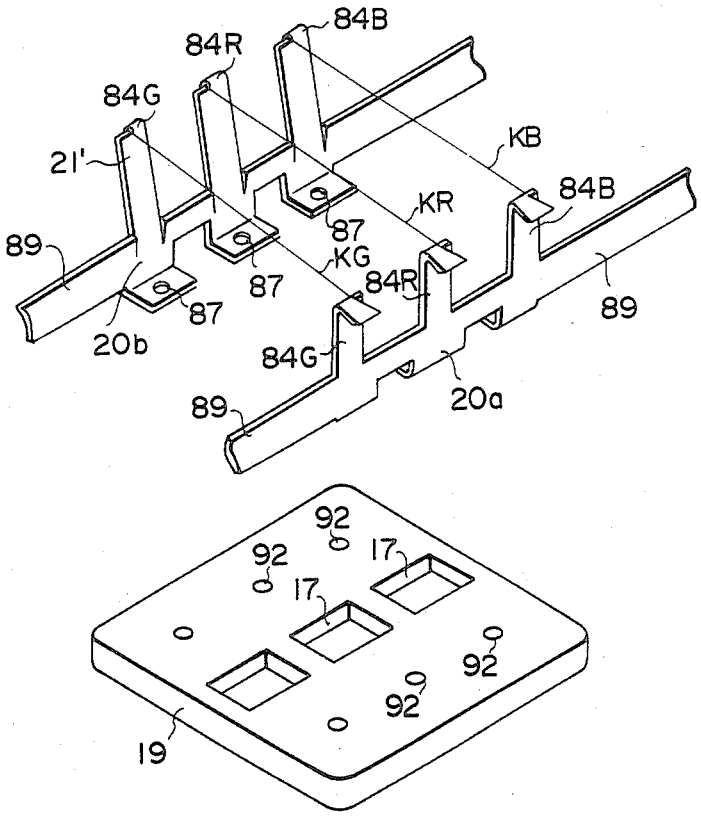
FIGS. 23 and 24 are perspective view and cross-sectional view showing still another example of the wire cathode support structure in the electrode unit.
Figure 24:
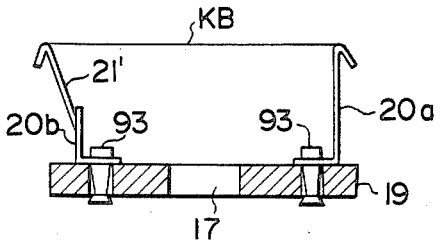

FIGS. 23 and 24 show still another embodiment of the conductive lugs 20*a* and 20*b* for stringing the wire cathodes K. In this example, the wire cathode attachement sections 84G, 84R and 84B are connected to one another, a lead 89 is formed outwardly from the attachments 84G and 84B along the connector 88, and the attachments have their ends 85G, 85R and 85B bent at right angles toward the partner lug 20*a* or 20*b* with a through-hole 87 being formed at each end section. The ceramic base 19 is formed therein pairs of through-holes 92 for receiving the conductive lugs 20*a* and 20*b* at positions on both sides of the three openings 17 which receive the first grids G1. these through-holes 92 are located in coincident with the through-holes 87 in the attachments 85G, 85R and 85B of the lugs 20*a* and 20*b*.

Figure 30:
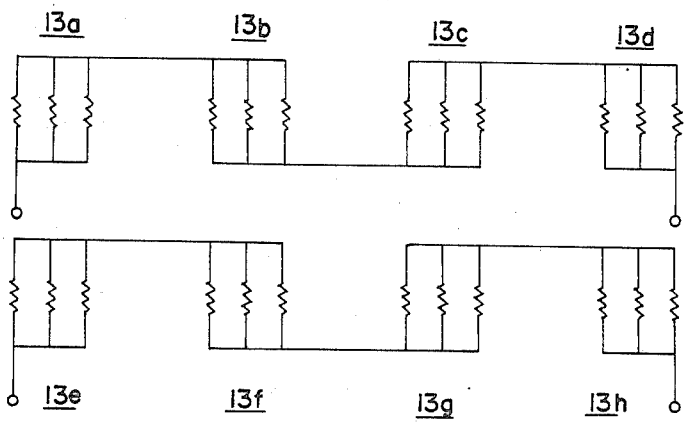

As shown in FIG. 24, the conductive lugs 20*a* and 20*b* are placed so that their through-holes 87 are coincident with the through-holes 92 in the ceramic base 19, and thereafter conductive taper pipes 93 are inserted from the side of the through-holes 87 into the through-holes 92 in the ceramic base 19 and they are secured to the ceramic base 19 by being calked at the end. Among two sections of the leads 89 extending in two directions from the lug 20*a* and 20*b*, one section may be cut off depending on the manner of connecting the cathods. When the cathodes are connected as shown in FIG. 30, the leads 89 of adjoining lugs are connected in series by direct spot welding.

Figure 17:
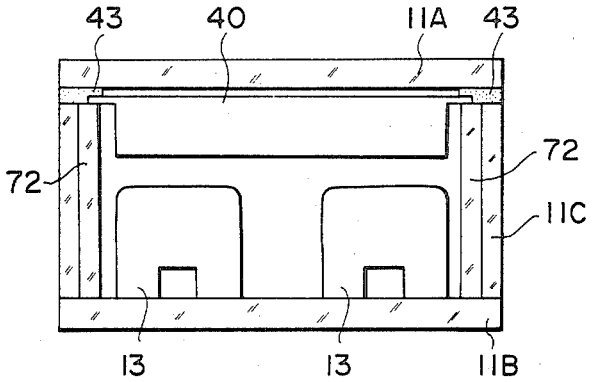
FIG. 17 is a cross-sectional view showing another embodiment of the fluorescent display apparatus.

In the above embodiment, the separator chassis 40 on the anode side is supported by clamping its tabs 43 between the front panel 11A and side board 11C of the glass casing 11. In this case, the tab 43 is dimensioned about half the thickness of the side board 11C, but if it is intended to enhance the withstand voltage between the tip of the tab 43 and the external surface of the glass casing, another glass plate 72 is placed on the inner side of the side board 11C of the glass casing 11 so that the tabs 43 of the separator chassis 40 are held between the glass plate 72 and the front panel 11A as shown in FIG. 17.

As an alternative way of supporting the separator chassis 40, the tabs 43 may be eliminated and the separator chassis 40 is fixed directly on the front panel 11A of the glass casing 11 using frit glass. In this case, the absence of the tabs 43 perfectly prevents discharging to the exterior of the glass casing and also discharging inside the glass casing, i.e., "surface discharging" along the side boards 11C. A care is needed for the front panel 11A so that a carbon layer 15 or metallic back layer 16 is not formed in sections where frit glass is applied. When the display unit is complete, the glass casing 11 has its front except for the fluorescent trios covered by a unit panel which also serves as a shield against the external light, and therefore the frit glass section is concealed.

Figure 25:
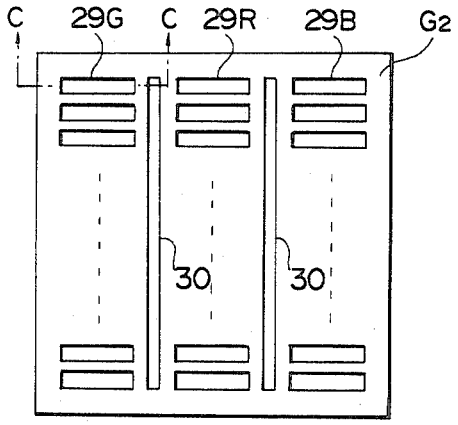
FIGS. 25 and 26 are plan view and cross-sectional view taken along the line C—C of the plan view, showing the second grid G2.
Figure 26:
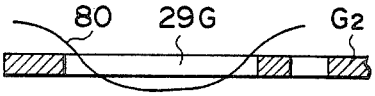
Figure 27:
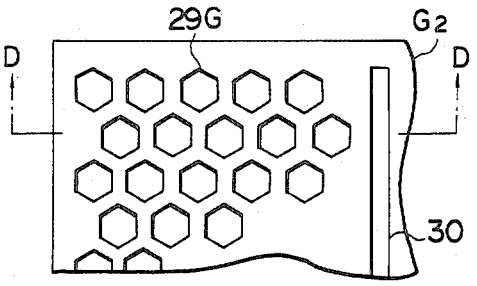
FIGS. 27 and 28 are plan view and cross-sectional view taken along the line D—D of the plan view, showing another example of the second grid G2.
Figure 28:
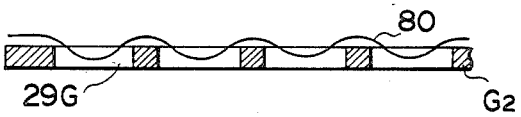

In the above embodiment, the second grid G2 has its meshes 29G, 29R and 29B formed in as slits, and the longitudinal dimension of each slit introduces the high electric field 80, as shown in FIGS. 25 and 26, resulting possibly in the formation of electronic lenses. To cope with this matter, the meshes 29G, 29R and 29B may be formed as fine hexagonal meshes as shown in FIG. 27, which precludes the entry of the high electric field (see FIG. 28), and the formation of electronic lenses can be avoided.

Figure 29:
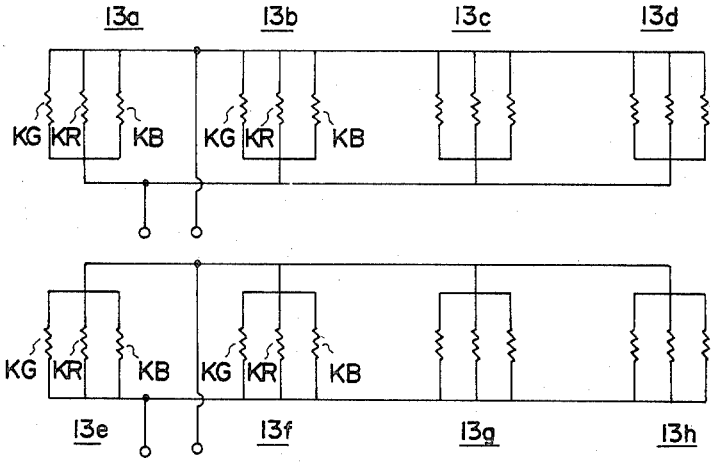
FIGS. 29 and 30 are schematic diagrams showing other examples of cathode connection.

In the above embodiment, the row of electrode units is selected by switching the voltage to the second grid G2, but it can also be accomplished in other way such as by switching the wire cathode K. In this case, the wire cathodes K of the electrode units 13*a*–13*d* are connected commonly as shown in FIG. 29 (parallel connection) or FIG. 30 (serial connection), and the wire cathodes K of the electrode units 13*e*–13*h* are connected commonly in the same way. In operation, the wire cathodes K connected commonly for the upper row and lower row are made active, a drive voltage of 0–5 volts or below, for example, is applied as a row selection voltage to each wire cathode, a drive voltage of 0–5 volts or below is applied to the first grid G1, and a fixed voltage of 10 volts or below is applied commonly to the second grid G2 of all electrode units 13*a*–13*h*. Accordingly, with the wire cathodes K of the upper electrode units 13*a*–13*d* being given 0 volt and those of the lower electrode units 13*e*–13*h* being given a cutoff voltage of 5 volts, for example, when a voltage of 5 volts, for example, is applied through the lead 64G1 to the first grids G1, the first fluorescent trio 12*a* is activated to illuminate. When the first grids G1 are brought to 0 volt, the electron beams are cut off, and corresponding fluorescent layers become inert. By application of the voltage through the leads 64G1, 65G1 and 67G1 to the first grids G1 sequentially, the upper fluorescent trios 12*a*–12*d* are activated to illuminate, and subsequently by switching the 0-volt drive voltage to the lower wire cathodes K and applying the 5 volts to the first grids G1 through the leads 64G1–67G1 sequentially, the lower fluorescent trios 12*e*–12*h* are activated to illuminate. In the above case, all electrode units 13*a*–13*h* are made to have their second grids G2 connected together.

Figure 31:
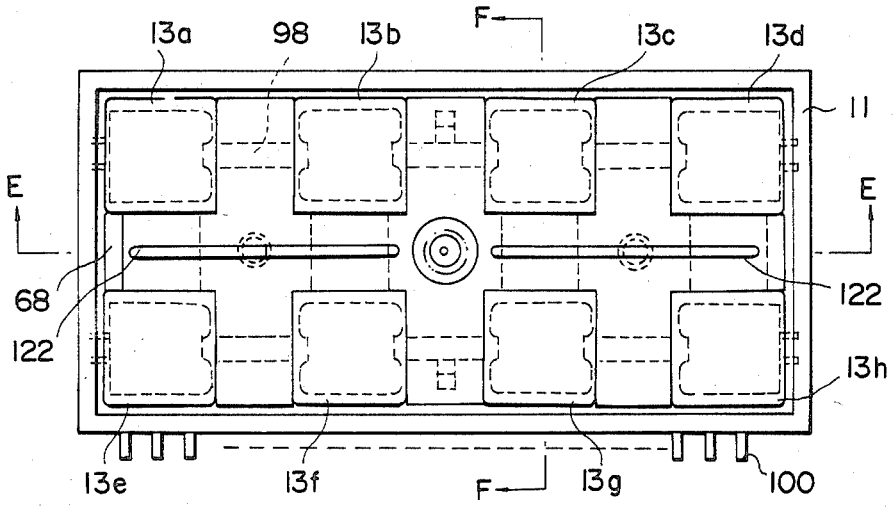
FIGS. 31, 32 and 33 are plan view, cross-sectional view taken along the line E—E, and cross-sectional view taken along the line F—F, showing another example of the electrode unit linkage structure.
Figure 32:
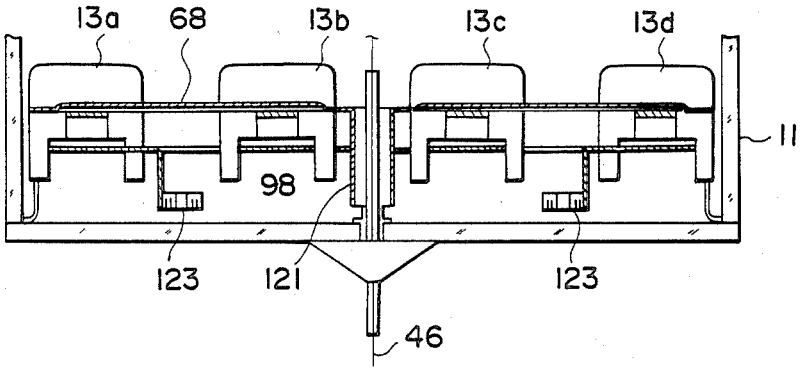
Figure 33:
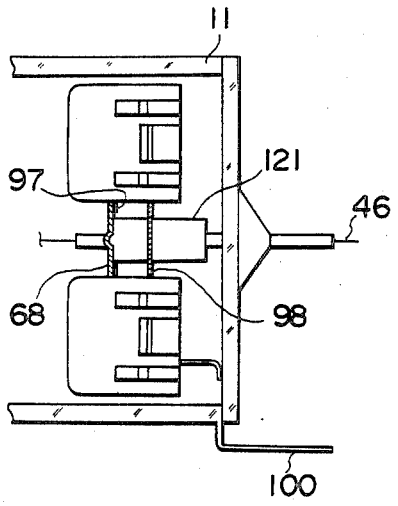

For example, as shown in FIGS. 31, 32 and 33, a common conductive subsidiary plate 68 is provided, cut sections 96 of the electrode unit casings 26 are bent, and the subsidiary plate 68 is spot welded to the bent sections 97 to accomplish the common connection for the second grids G2. At the same time, an integrated conductive retainer chassis 98 is used commonly for the eight electrode units 13*a*–13*h*, and the associated second grids G2 are connected together by means of the common conductive retainer chassis 98. The subsidiary plate 68 is provided as a unitary member a shielding cylinder 121 in which the anode lead 46 runs through, and reinforcement beads 122 expanded linearly are formed at the center on both sides of the cylinder 121. The common conductive retainer chassis 98 is provided thereon with annular getter containers 123 as a unitary member. The getter containers 123 have their getter material disposed to confront the rear panel of the glass casing 11.

Although it is not shown in the figures, the second grids G2 may be connected together by spot welding the subsidiary plate 68 to the retainer chassis 34 for the electrode units 13*a*–13*d* and 13*e*–13*h*, or by spot welding the subsidiary plate 68 to the bent sections 97 of both electrode unit casings 26 placed in the retainer chassis 34.

Although the above embodiment has the arrangement of eight fluorescent trios, the number of sets is not limited to this, but can be selected arbitrarily.

Figure 34:
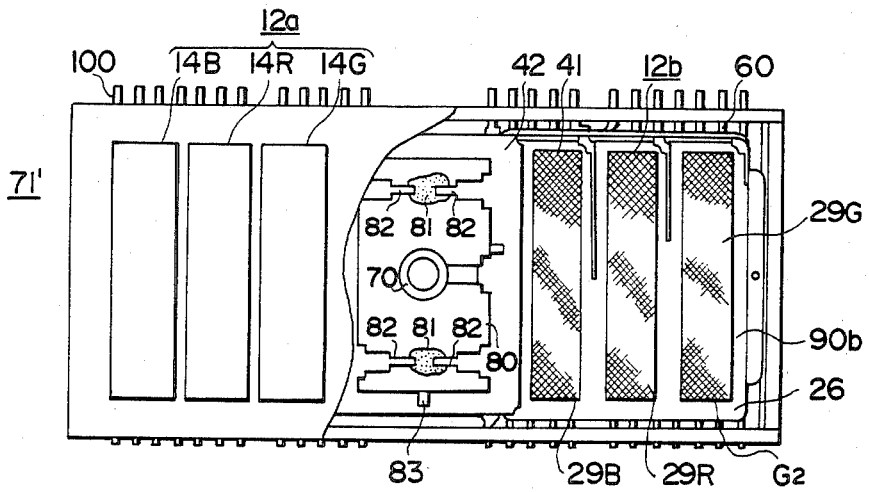
FIGS. 34 and 35 are front view and side view partially broken away showing another embodiment of the fluorescent display apparatus.
Figure 35:
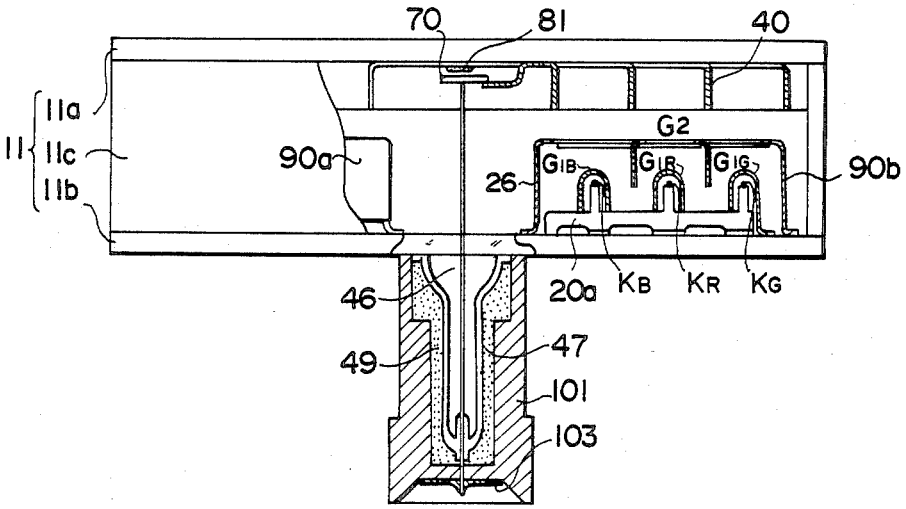

FIGS. 34 and 35 show an embodiment of the display cell having two sets of fluorescent trios. In this embodiment, two sets of electrode units 90 (90*a*, 90*b*) are disposed in a glass casing 11 dimensioned by 39 mm longitudinally by 86 mm laterally for its front panel 11A, which has on its interior wall two sets of fluorescent trios 12 (12*a*, 12*b*) confronting the respective electrode units 90. On the part of the fluorescent screen, conductive separator chassis 40 are disposed to surround the fluorescent layers 14R, 14G and 14B of the trios 12.

The electrode unit 90 consists of a unit casing 26 on which is spot welded is a second grid G2 having fine hexagonal meshes 29B, 29R and 29G, three first grids G1B, G1R and G1G, and three wire cathodes KB, KR and KG each strung between a pair of conductive lugs 20*a* and 20*b*. The unit casing 26, which constitutes part of the second grid G2, the first grids G1 and the pairs of lugs 20*a* and 20*b* are all directly spot welded to a lead frame 60 provided on the inner wall of the rear panel 11B of the glass casing 11 so that these components are supported electrically and mechanically.

Figure 37:
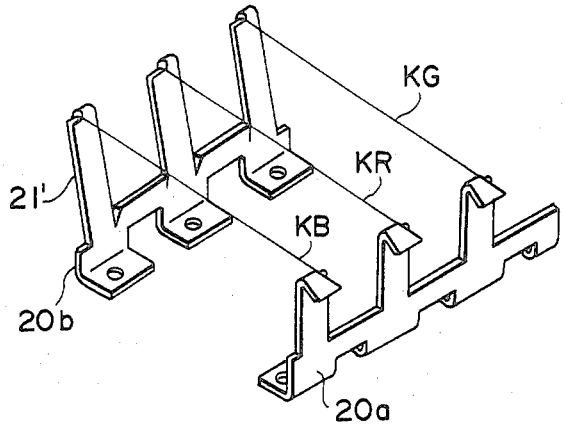
FIG. 37 is a perspective view showing an example of the wire cathode support.

The wire cathodes K are supported by E-shape conductive lugs 20, one 20*a* as a fixing lug, the other 20*b* provided with spring sections 21', as shown in FIG. 37. the lugs 20a and 20b have their ends, where the wire cathodes KB, KR and KB are swung, cut and bent for the purpose of centering the wire cathode K.

In this embodiment, a conductive getter container 70 is disposed at a position close to the front panel 11A by being supported electrically and mechanically by part of the separator chassis 40, and an anode lead 46 is connected to the getter container 70.

Figure 36:
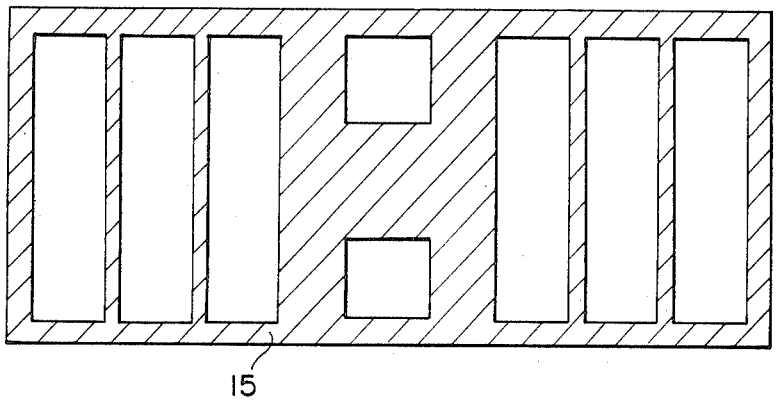
FIG. 36 is a plan view showing the pattern of the carbon layer.

The separator chassis 40 are mounted without use of the tabs 43, but directly fixed on the front panel 11A of the glass casing 11 using frit glass 81. Namely, the separator chassis 40 is formed in its electrode plate an opening 80, in which extended portions 82 are fixed to the front panel 11A by the frit glass 81. In this case, a care should be taken so that no carbon layer 15 or metallic layer is dsposited in sections on the front panel 11A where the frit glass 81 is bonded. On this account, the carbon layer 15 is patterned as shown in FIG. 36. The separator chassis 40 is provided on the rim of the opening 80 a number of cut protrusions 83, which are bent to have elastic contacts with the metallic back layer 16 and carbon layer 15, so that an electrical connection is made between the fluorescent screen and the separator chassis 40 through the cut protrusions 83. When several cells 71' are arranged to complete a display unit, the front panel of the glass casing 11 is further covered except for the fluorescent trios by a unit panel which also serves to preclude the external light, and therefore the frit glass is concealed. Accordingly, when the separator chassis 40 is fixed directly to the front panel 11A of the glass casing 11, the supporting tabs 43 are omitted, which prevent discharging to the exterior of the glass casing and also "surface discharging" along the inner surface of the side boards 11C. The above-mentioned support for the separator chassis 40 and contact between the separator chassis 40 with the fluorescent screen can also be applied to the previous embodiment shown in FIGS. 1 and 2. Through the arrangement of several display cells 71' shown in FIGS. 34 and 35, a display unit with a large screen is realized. In fabricating the display cell 71', a green, red and blue fluorescent layers 14G, 14R and 14B may be aligned in the same order for both rows (horizontal lines) as in the previous embodiment. Alternatively, the green and blue fluorescent layers 14G and 14B may be transposed at every row (horizontal line), with the result of enhanced apparent resolution.

The aforementioned fluorescent display cells 71 and 71' are assembled in a unit panel to form a unit, and many units are arrayed to complete a display unit having a large screen. In case of a display cell 71 incorporating eight fluorescent trios, 32 cells (8 longitudinally by 4 laterally), for example, are arrayed to form one unit, and several units are arranged in matrix to complete a large display screen.

Figure 38:
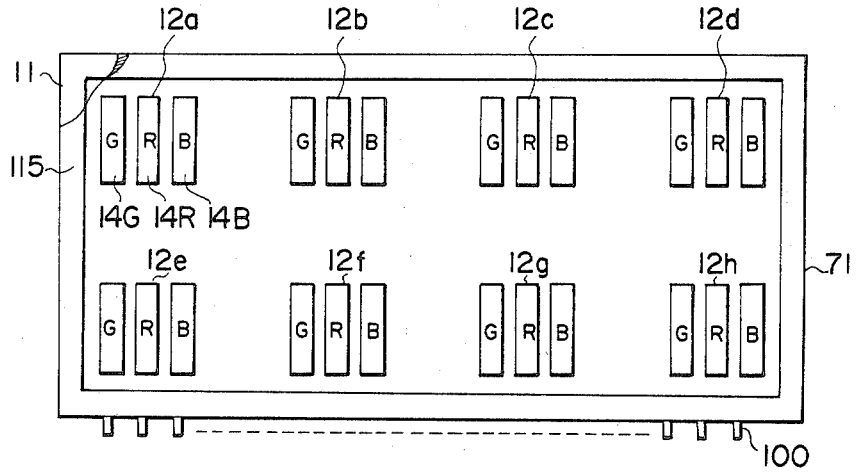
FIGS. 38 and 39 are front view and partially cross-sectional side view showing another embodiment of the fluorescent display apparatus.
Figure 39:
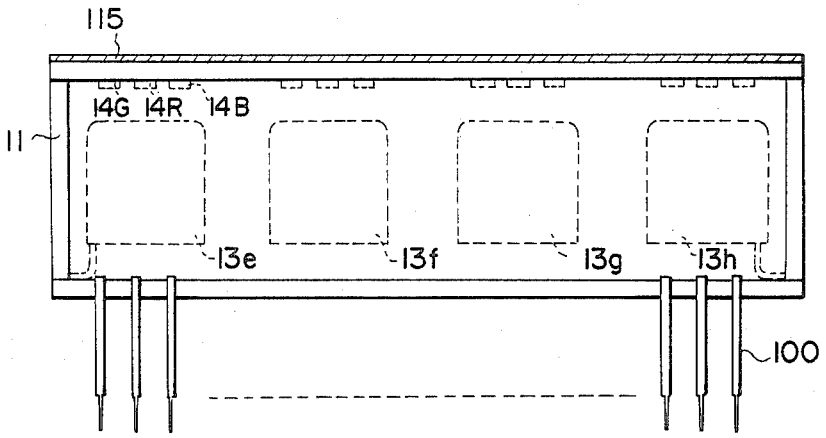
Figure 40:
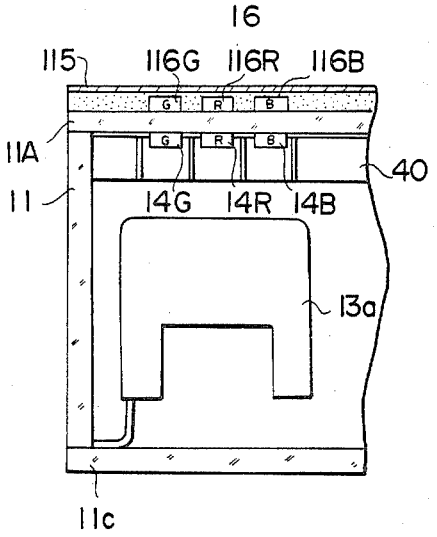
FIG. 40 is a cross-sectional view showing the principal portion of still another embodiment of the fluorescent display apparatus.

In constructing a large display screen through the arrangement of many display cells 71 or 71' described above, the contrast and picture quality can possibly be deteriorated due to the external light reflection on the display screen. To cope with this matter, each display cell 71 and 71' is rendered mat process for prevention of reflection. For example, in the embodiment shown in FIGS. 38 and 39, a mat-processed resin film 115 with a light transmissivity of little higher than 90% is sticked on the surface of the display cells 71, i.e., on the surface of the front panel 11A. In this case, the resin film 115 is made of a film capable of preventing the external light reflection and also blocking ultraviolet rays. This ultraviolet ray blocking resin film 115 is effective when a color filter 116 consisting of a red, green and blue filter components 116R, 116G and 116B in correspondence to the red, green and blue fluorescent layers 14R, 14G and 14B of the fluorescent trio 12 is formed on the front panel 11A of display cells 71 with the intention of enhanced contrast. Namely, organic dye of the color filter 116 can discolor when shone by the ultraviolet rays, but it can be avoided by provision of the resin film 115.

Mat processing for the surface of the display cells, beside the above-mentioned use of the resin film 115, includes a method of etching for roughening the glass surface of the front panel 11A and a method of spraying clear lacquer or coating $SiO_2$ on the glass surface of the front panel 11A for making it rough.

Figure 41:
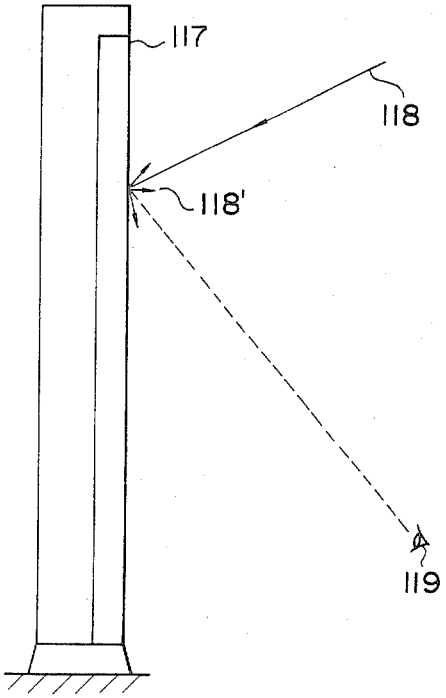
FIG. 41 is a side view of the display apparatus used to explain the prevention of external light reflection.

By the mat process for the surface of the display cells in constructing a large display screen 117 as shown in FIG. 41, the external light 118; is dispersed on the display screen as shown by 118', alleviating its influence on the viewer's eyes 119, whereby the deterioration of the contrast and picture quality can be avoided. Use of the mat-processed resin film 115 is advantageous in the manufacturing cost and stability, and it is also effective for the protection of the glass surface of the front panel 11A.

Next, the assembly of units using the display cells 71 will be described.

Figure 42:
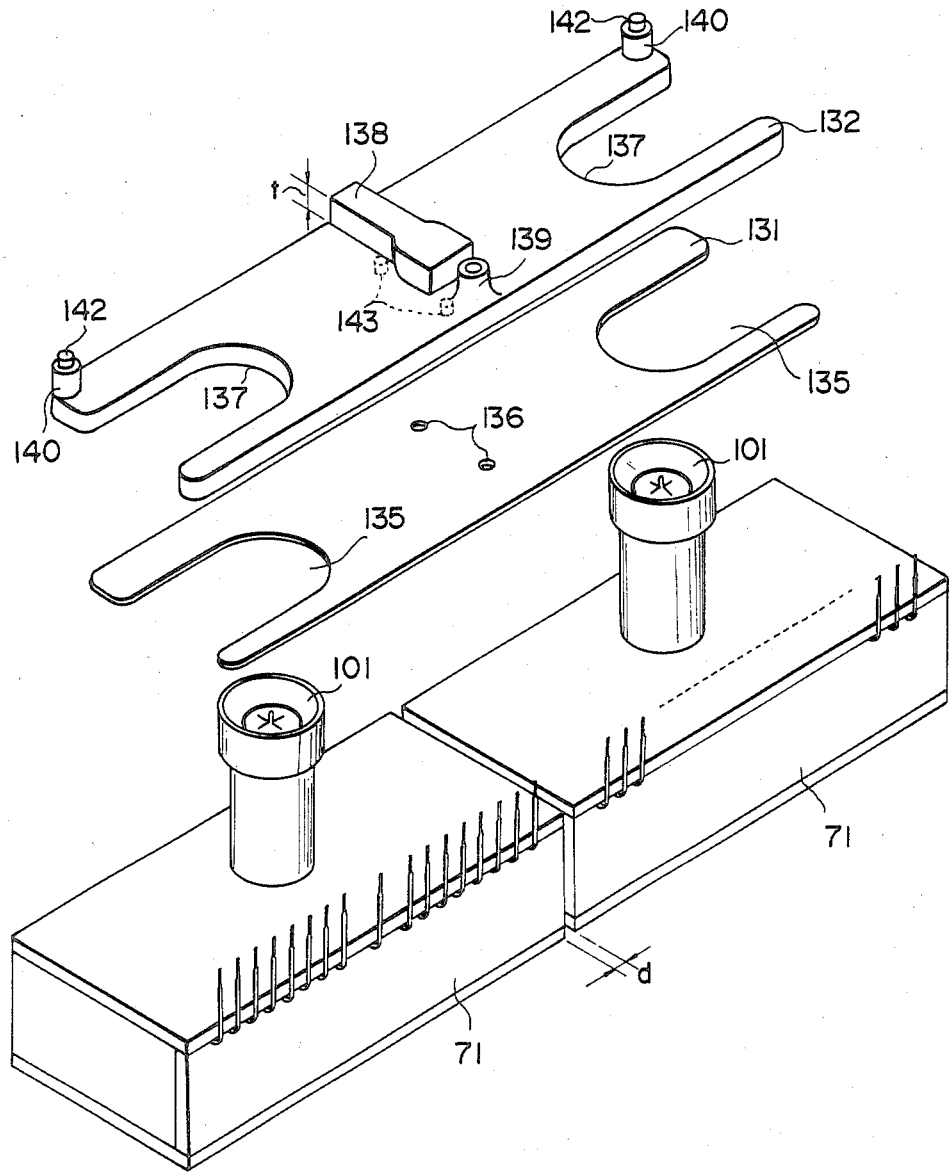
FIGS. 42 and 43 are perspective views showing the components and complete assembly of the fluorescent display tube block made up of two display tubes in pairs.
Figure 43:
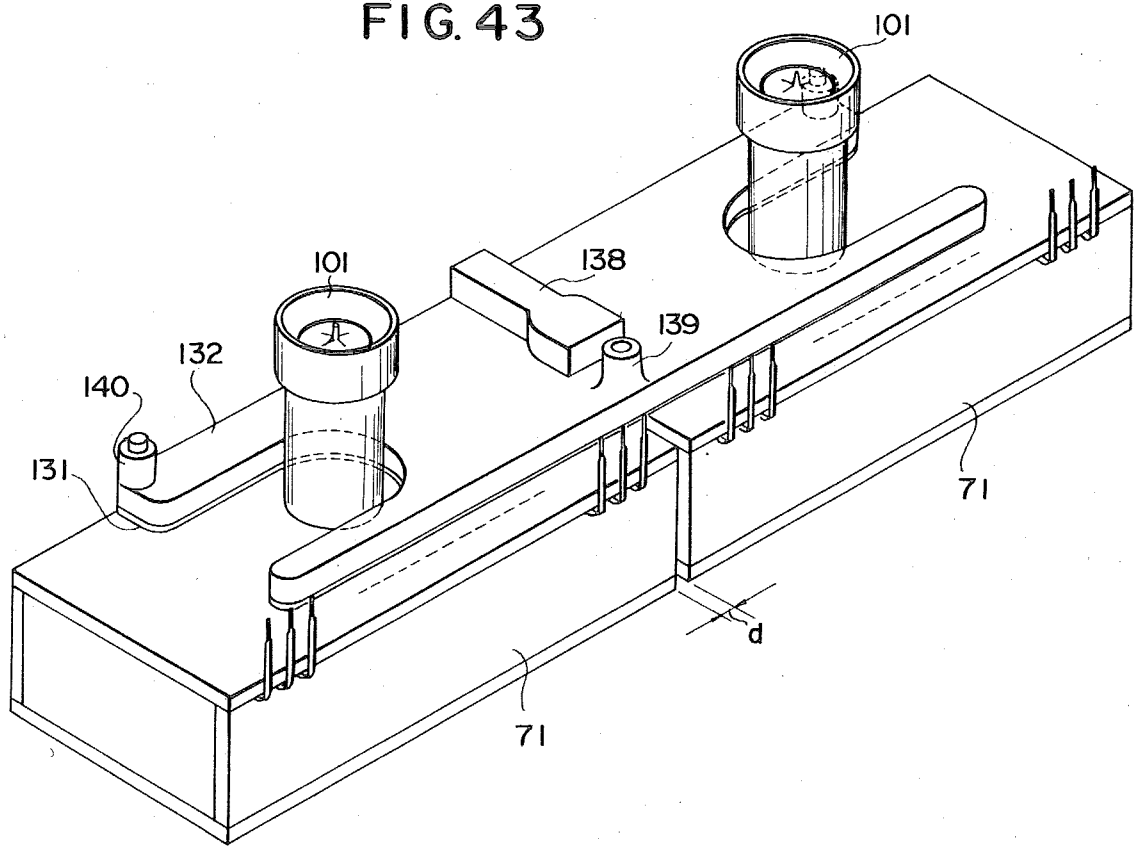
Figure 44:
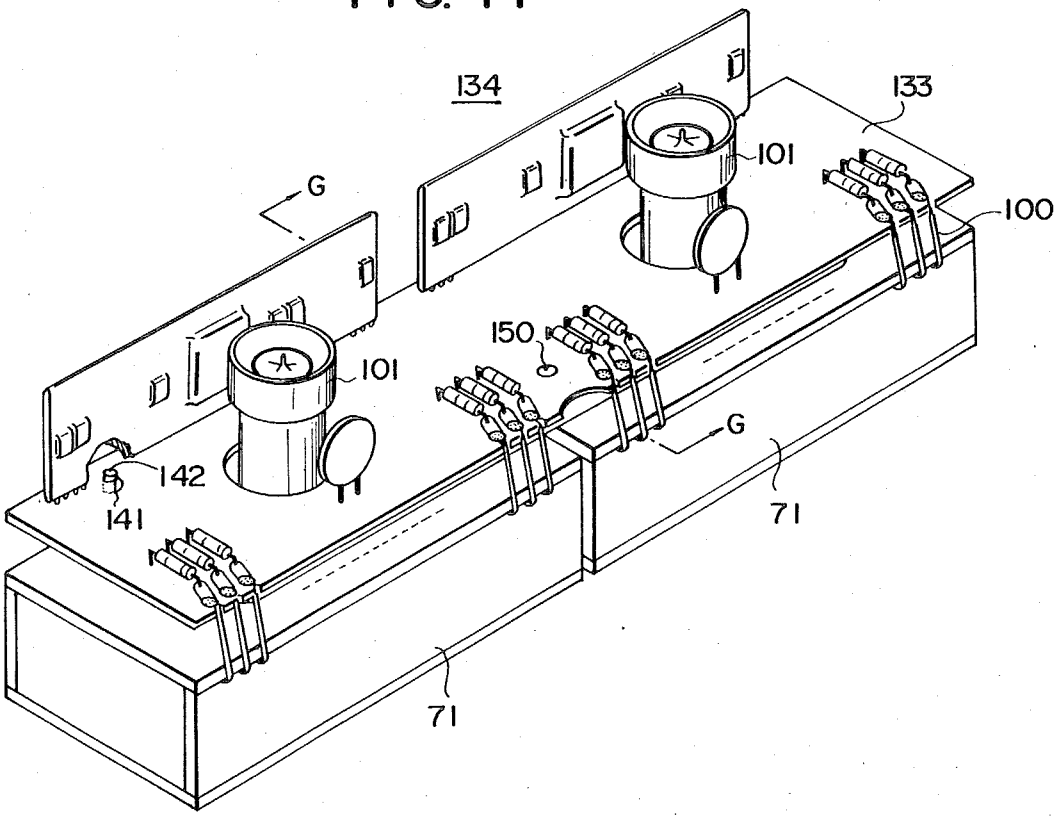
FIGS. 44 and 45 are perspective view and cross-sectional view taken along the line G—G of the perspective view showing the fluorescent display tube block.
Figure 45:
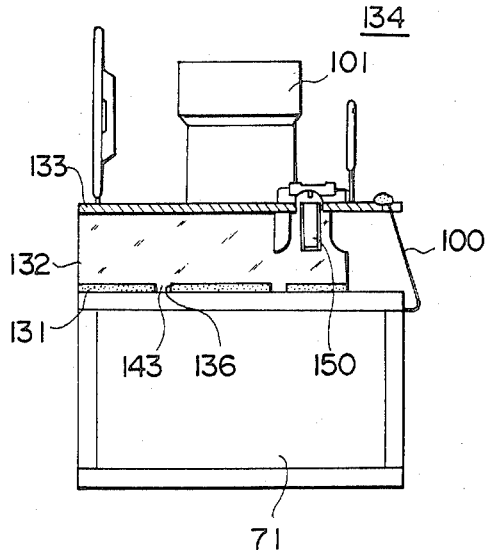

First, two display cells 71 are placed with a spacing d of 2–3 mm, for example, between each other, and they are integrated by being bonded on a cell mount base 132 made of synthetic resin, which also serves as a spacer, with a cushion 131 having pressure-acting adhesive applied on its both sides interleaved between the cells and the cell mount base, as shown in FIGS. 42 and 43. The cell mount base 132 is overlaid with a common wiring boad 133 of the drive circuits for the cells 71 is completed as shown in FIGS. 44 and 45. The cushion 131 has cuts 135 for receiving the insulation cylinders 101 of the anode leads for the two display cells coming from the rear panel 11B, and further has holes 136 used for positioning with the cell mount base 136 at the center (at the position coincident with the spacing of the two display cells 71).

The cell mount base 132 has the same cuts 137 as those 135 of the cushion 131 at the corresponding position to have the same planar configuration, and further has as a unitary member at the center of one side a spacer 138 and nut 139 having a height of t aligning along the traversing direction of the cell 71 and other spacers 140 having the same height t at both ends and the same side of the base. The nut 139 is located on the side of the lead 110 of the display cell 71, while the spacer 140 is located on the opposite side. The spacers 140 are provided on the top thereof protrusions 142 which engage with the positioning holes 141 of the drive circuit board 133. Further provided on the other side of the cell mount base 132 are protrusions 143 which engage with coupling holes 136 of the cushion 131. The drive circuit board 133 has through-holes 144 for receiving the insulation cylinders 101 of the anode leads protruding from both display cells 71, and a hemicyclic cut 145 for passing boss 156 of the unit panel 151, as will be described later, at the center of one side edge. The drive circuit board 133 is placed on the spacers 138 and 140 and nut 139 of the cell mount base 132 so that the insulation cylinders 101 of the display cell comes into the through-holes 144, and secured to the cell count base 132 by driving screws 150 from the drive circuit board 133 into the nuts 139. In this case, the cell mount base 132 is positioned correctly by the engagement of the protrusions 142 of the base 132 with the holes 141 of the circuit board 133. After the drive circuit board 133 and cell mount base 132 have been assembled using the screws, the leads 100 of the display cells 71 are connected more tightly.

Figure 47:
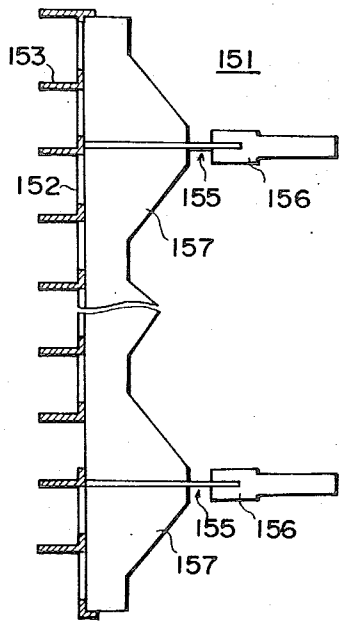
FIGS. 46 and 47 are front view and cross-sectional view of the unit panel.
Figure 46:
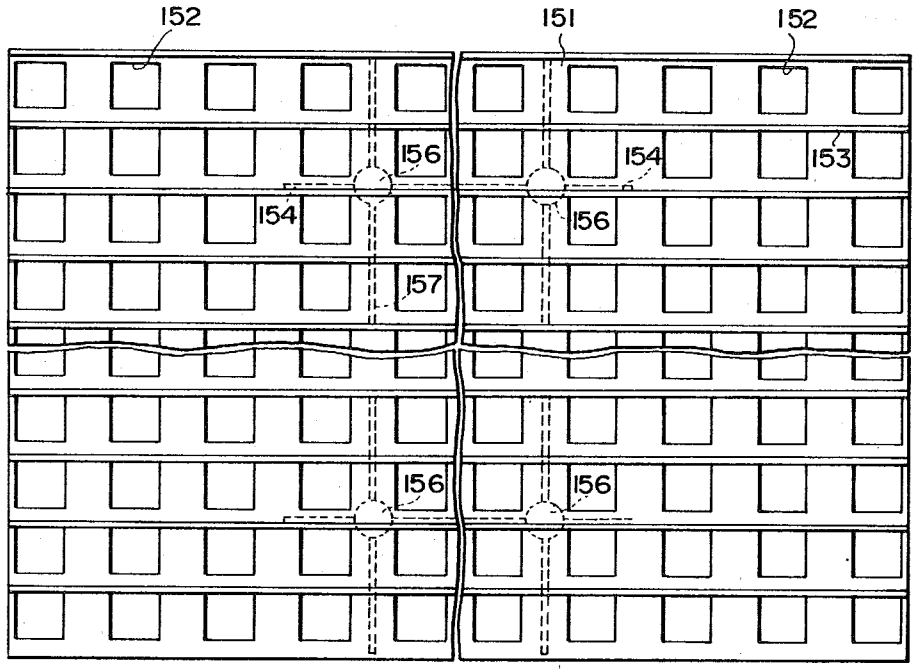
Figure 48:
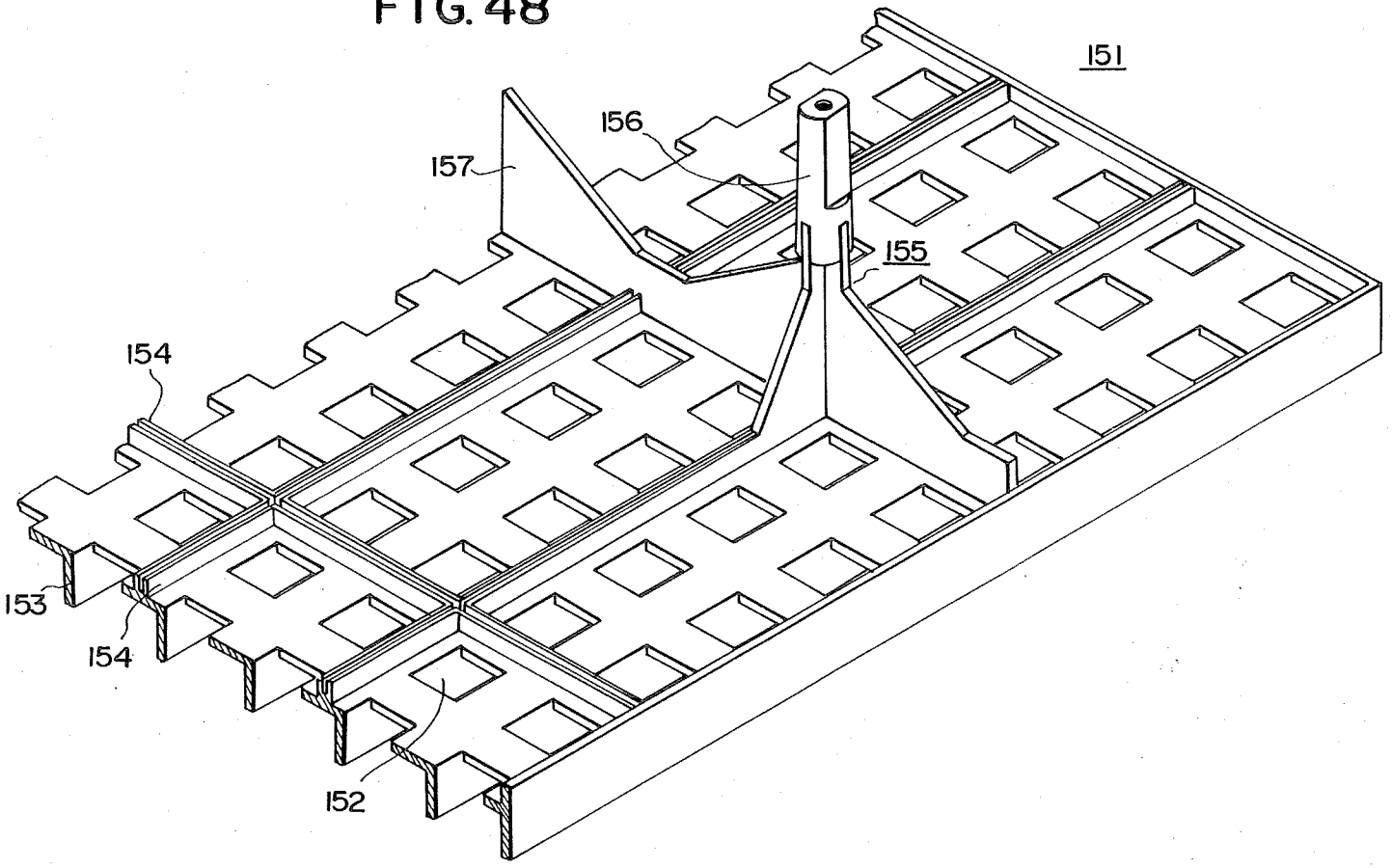
FIGS. 48 and 49 are perspective views showing the principal portion of the unit panel and its components.

There is provided a unit panel 151 as shown in FIGS. 46, 47 and 48. The unit panel 151 is designed to lay 32 display cells (8 longitudinally by 4 laterally), for example, and has an array of 256 windows 152 at positions coincident with fluorescent trios 12 or 32 display cells 71. The unit panel 151 is provided on its surface lines of visors 153 on one side of each window 152. The unit panel 151 has as a unitary member on its other side cross fences 154 for positioning the display cells 71, and guide posts 155 at the intersections of the fences each supporting four display cells 71.

Figure 49:
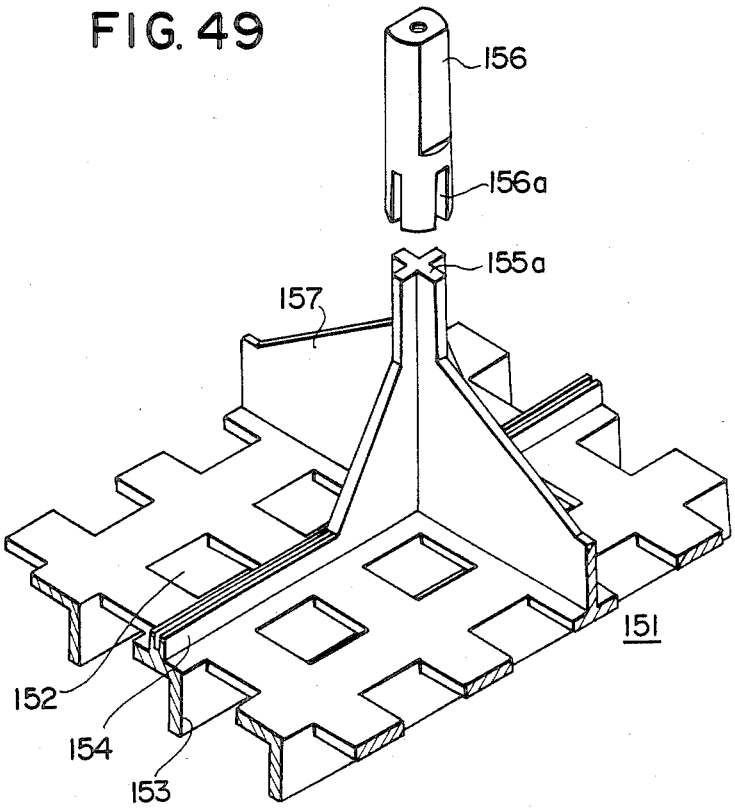
Figure 52:
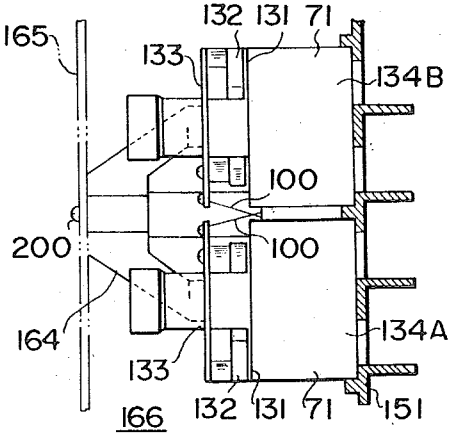
FIGS. 50, 51 and 52 are rear view, top view and side view showing the principal portion on the back of the unit and its components.

The guide post 155 consists of a boss 156 for holding the display cell 71 and a guide section 157 extending longitudinally and laterally from the root of the boss 155, with the longitudinal guide section 157 at right angles to the visor 157 being formed continuously to the counterpart of the adjacent post. The boss 156 is provided separately from the unit panel 151 as shown in FIG. 49, and it is bonded firmly to the top 155*a* of the guide section. In this case, a cross groove 156*a* of the boss 156 is engaged with the cross-shaped top 155*a* of the guide section 157 and both members are bonded to form a unitary member.

Figure 53:
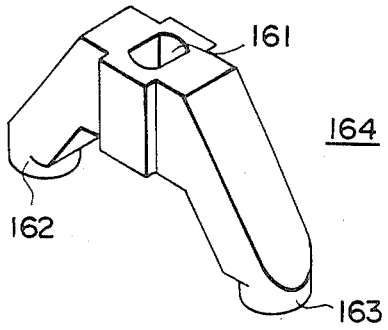
FIG. 53 is a perspective view of the holder.
Figure 50:
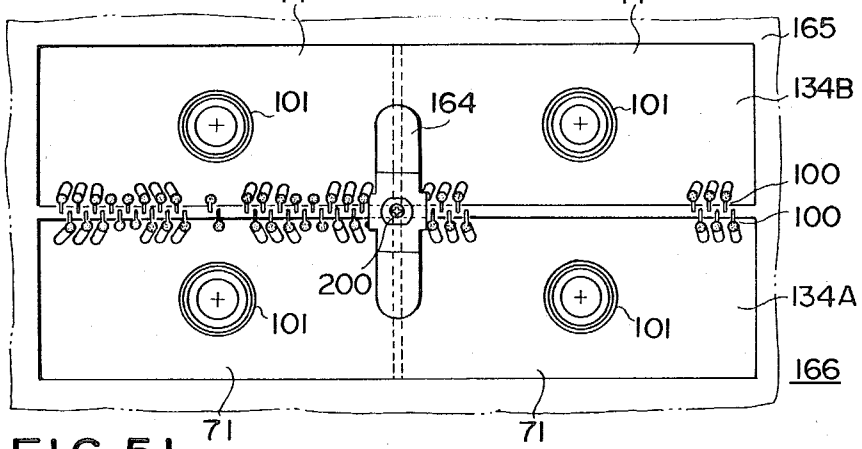
Figure 51:
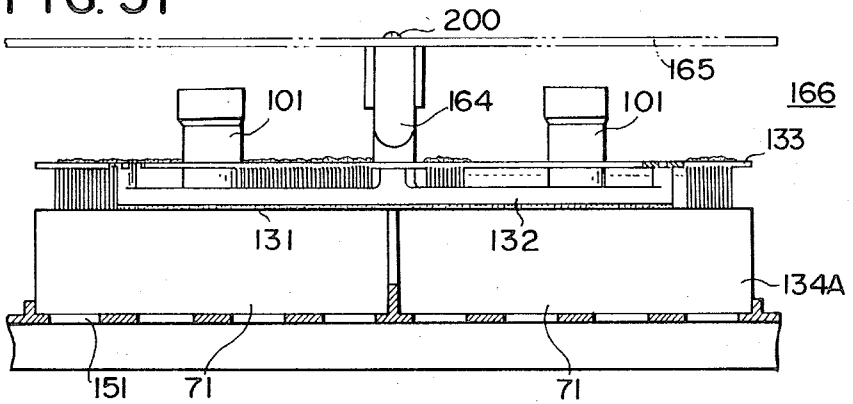
Figure 54:
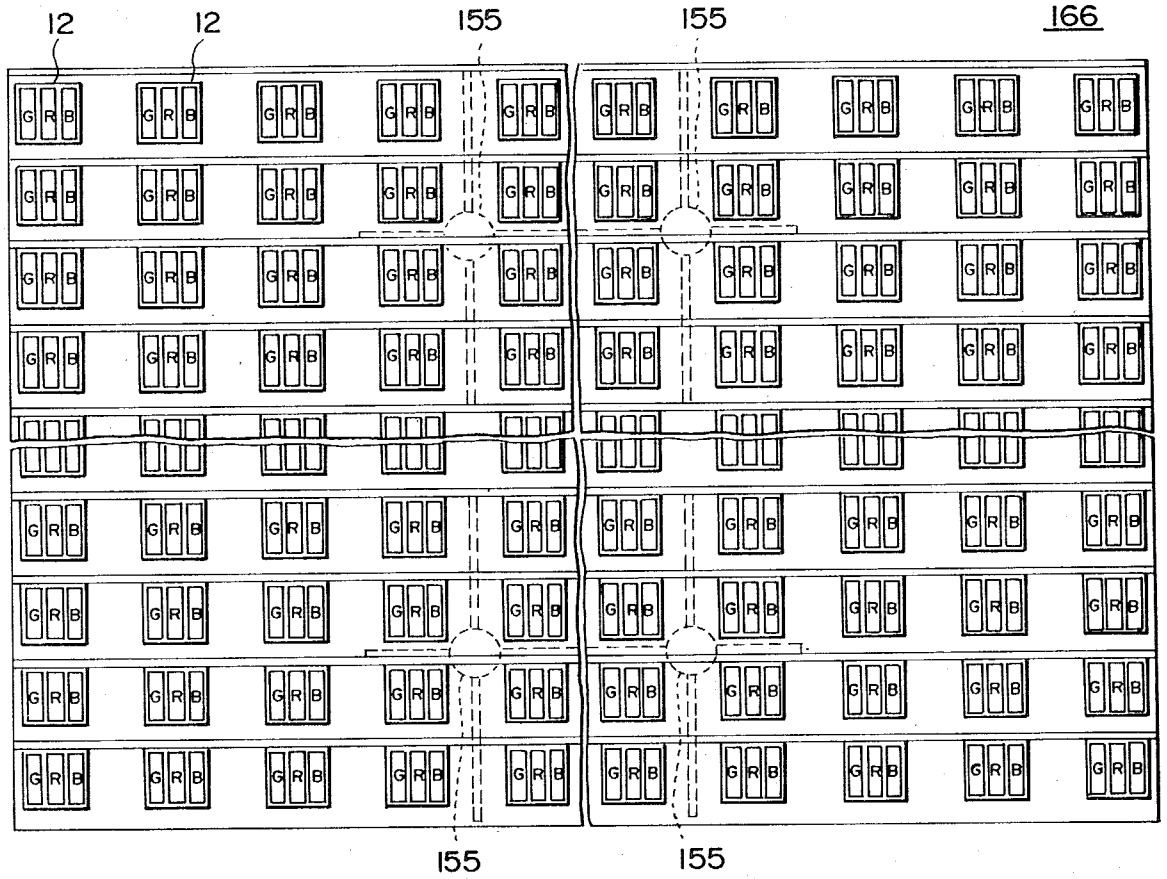
FIG. 54 is a front view showing an example of the complete unit.

As shown in FIGS. 50 and 51, a certain number of display tube blocks 134, each being the aforementioned integrated two display cells 71, are laid out on the rear side of the unit panel 151. The adjacent display cells 71 are separated by the fences 154 and guide sections 157. The boss 156 protruding at the center between the adjoining two display tube blocks 134 is coupled with a V-shape holder 164 having foot sections 162 and 163 and a boss hole 161 located therebetween such that the foot sections 162 and 163 are in contact with the drive circuit boards 133 of the adjoining display tube blocks 134 as shown in FIG. 53. Subsequently, a chassis 165 with a high-voltage line, power lines and signal lines being attached thereon is placed on the holders 164, and the chassis 165 is secured to the bosses 156 using screws 200. Two blocks 134 are held by the holder 164, i.e., each set of four display cells 71 is held by a common holder 164, and a unit 166 shown in FIG. 54 is completed.

Figure 55A:
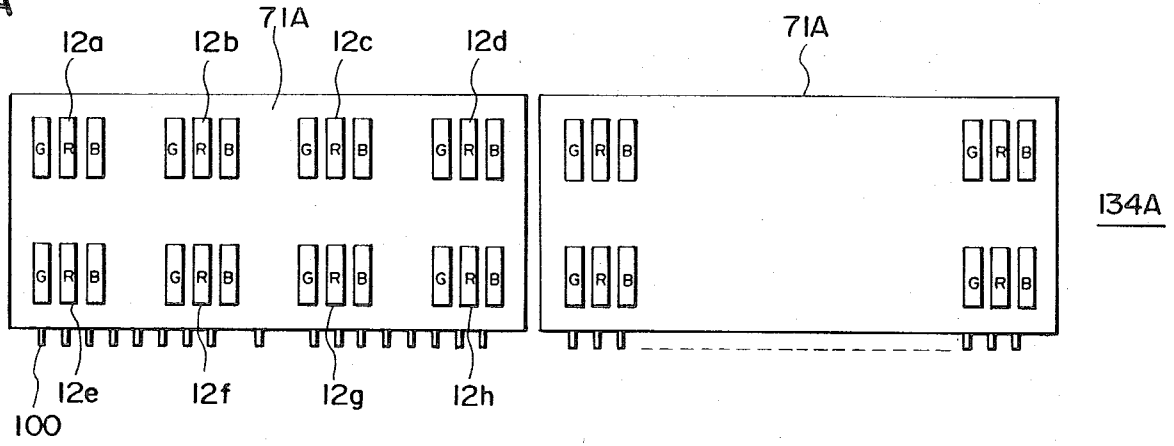
FIGS. 55A and 55B are a set of plan views each showing an example of the fluorescent display tube in one block.
Figure 55B:
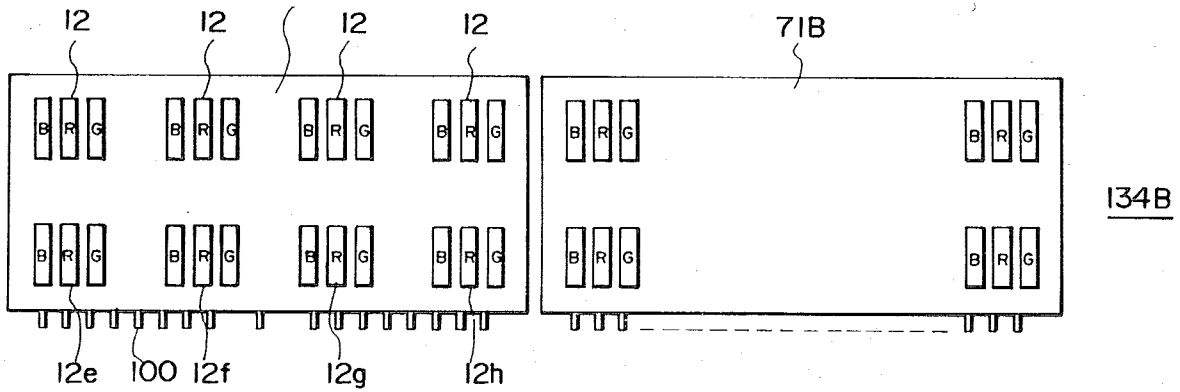

In assembling the unit 166, display tube blocks 134A including the display cells 71A, each being an array of fluorescent trios 12 in the order of green fluorescent layer 14G, red fluorescent layer 14R and blue fluorescent layer 14B as shown in FIG. 55A, and display tube blocks 134B including the display cells 71B, each being an array of fluorescent trios 23 in the opposite order of blue fluorescent layer 14B, red fluorescent layer 14R and green fluorescent layer 14G as shown in FIG. 55B are disposed. Both display cells 71A and 71B have their leads 100 on the same side in such a manner that each lead of one cell is located between adjacent ones of another cell. Both display tube blocks 134A and 134B are placed on the unit panel 151 so that their leads 100 confront each other as shown in FIG. 50. Both blocks 134A and 134B have their leads 100 confront each other as shown in FIG. 50. Both blocks 134A and 134B have their leads 100 aligned so that each lead of one block is located between adjacent ones of another block. The confronting arrangement of leads 100 of the display cells eliminates the need of wiring leads on the side of the unit 166, allowing the unit panel 151 not to have a space for the bend of leads 100, whereby dead spaces can be eliminated.

The arrangement of two display cells 71 into one block 134 simplifies the overall assembling process in constructing the unit 166, and the inspection at the stage of blocks facilitates the test and maintanence (servicing) jobs.

Fixing of four display cells 71 by the single boss 156 reduces the number of fixing points and the total number of bosses 156, and at the same time facilitates the replacement of a display cell 71, accordingly, a block 134 in the repairing job.

The unit panel 151 is reinforced in the lateral direction by the visor 153 extending laterally on its surface and in the longitudinal direction by the guide section 157 running longitudinally on the rear side, whereby the unit panel 151 has the enhanced mechanical durability as the whole.

Figure 56:
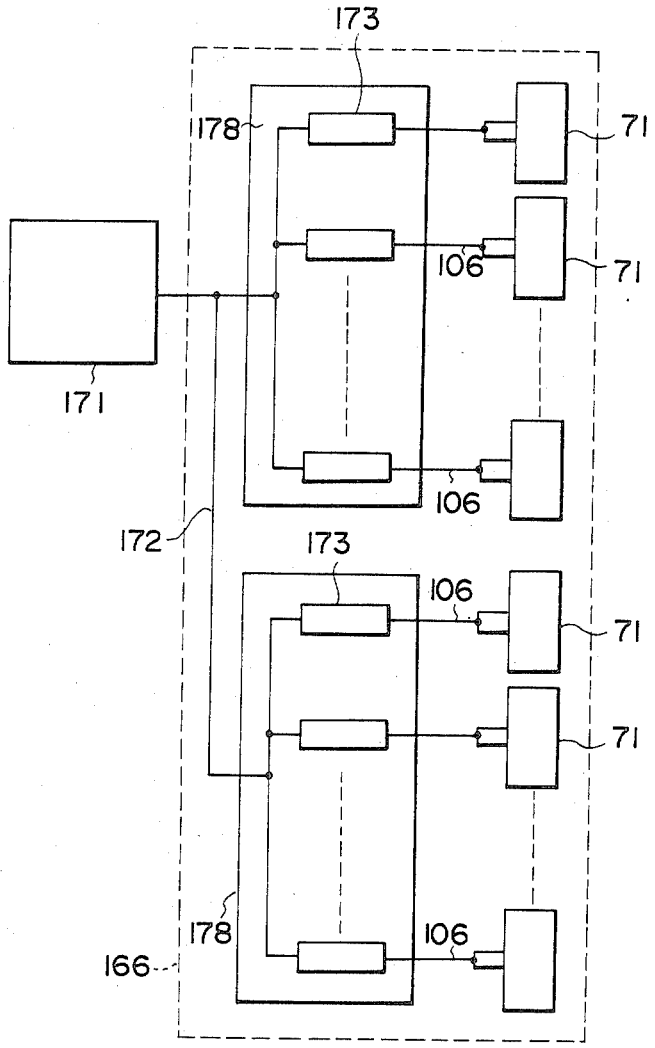
FIG. 56 is a schematic diagram of the display apparatus in which a protective resistor is provided for each display tube.
Figure 57A:
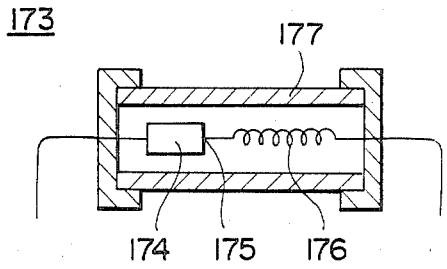
FIGS. 57A and 57B are a set of cross-sectional views showing an example of the protective resistor.
Figure 57B:
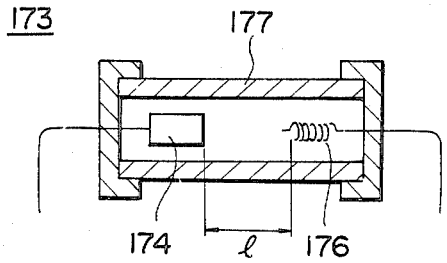
Figure 58:
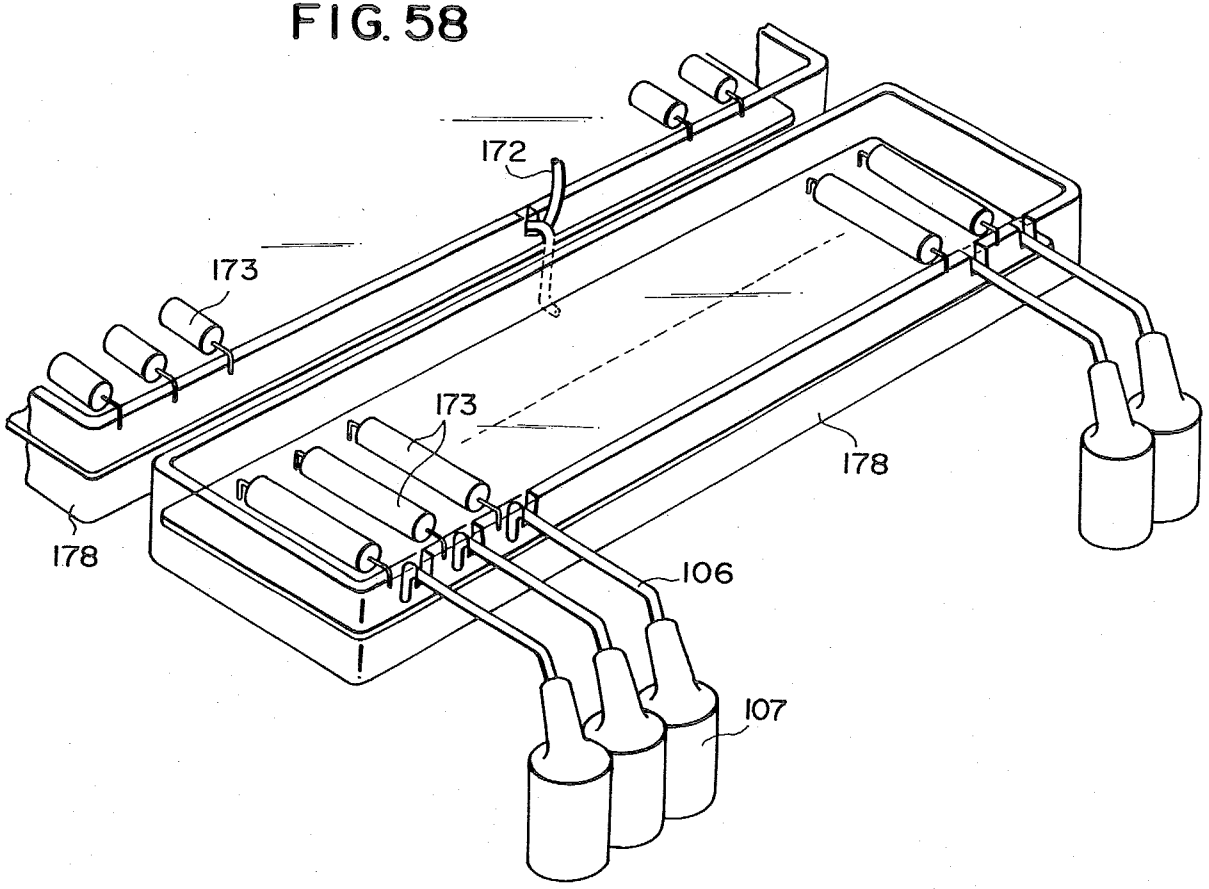
FIG. 58 is a perspective view showing the protective resistors accommodated in the case.

As shown in FIGS. 54 and 56, the unit 166 including 32 display cells 71 (8 longitudinally by 4 laterally) has an associated high-voltage power source 171, from which high-voltage leads 172 are connected to the 32 display cells 71. A protective resistor 173 of 100Ωk, for example, is inserted on the high-voltage lead 172 between the high-voltage power source 171 and each display cell 71. The protective resistor 173 is a "fuse resistor" as shown for example in FIG. 57A, in which a 100Ωk resistor body 174 and a spring 176 in connection with one end of the resistor body 174 through a low-fusion metal (i.e., fuse) 175 are enclosed in an insulation cylinder 177, and it operates such that when a large current flows through the fuse resistor 173, the low-fusion metal 175 melts due to the heat caused by the current, causing the spring 176 to contract elastically off the resistor body 174 and break the circuit, as shown in FIG. 57B. In the state of breakage, the resistor body 174 and the spring 176 have a distance l enough to ensure the withstand voltage (e.g., 8 mm or more). The 32 protective resistors 173 are accommodated in two cases 178, 16 pieces in each case, as shown in FIGS. 56 and 58. Each resistor 173 has one end connected by a lead 106 to a connection means 107, and another end connected commonly by a lead 172 to the high-voltage power source 171. The connection means 107 is coupled with the insulation cylinder 101 of the anode lead 46 of the display cell 71, and the voltage from the high-voltage power source 171 is supplied to each display cell 71.

In the above arrangement, if an excessive current flows in the display cell 71 due to internal discharging or glow discharging caused by insufficient vacuum created by leakage, the discharge current I for the case of a 100 kΩ protective resistor 173 and 8 kV anode voltage HV will be $I=8\times10^3=0.08$ ampere. Assuming the high-voltage power source 171 to have a current capacity of 13 mA, the power dissipation is as large as $0.013^2\times100\doteq17$ watts, and the resistor 173 only in the display cell 71 in which the excessive current has flowed will break. This causes the failure of illumination only in a defective cell within a unit 166, and it does not affect other cells.

Internal discharging in a display cell would damage or lower the output voltage (in case of a small current capacity) of the high-voltage power source 171, which would blacken all display cells in one unit, however, provision of a protective resistor in each display cell avoids such a situation.

Figure 67:
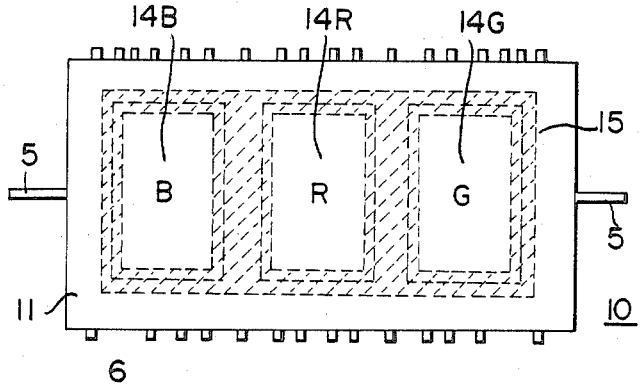
FIG. 67 (PRIOR ART)
FIGS. 67 and 68 are front view and cross-sectional view showing another embodiment of the fluorescent display apparatus.
Figure 68:
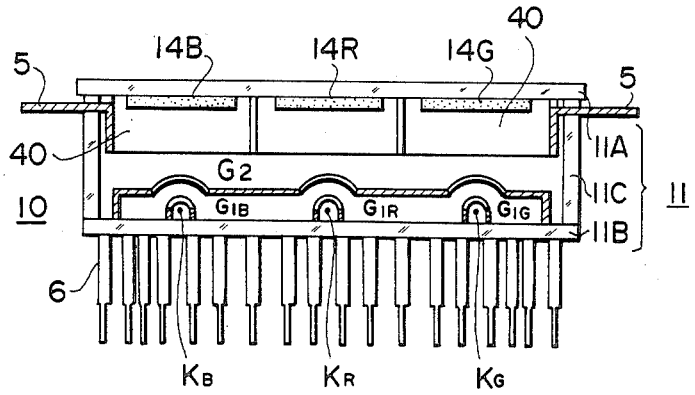
FIG. 68 (PRIOR ART)

In the foregoing embodiment, the display cells 71 and 71' are rendered on the surface the reflection-preventive mat process (coating of the resin film 115, etching of the glass surface, clear lacquer spray on the glass surface, or coating of $SiO_2$ as shown in FIGS. 38 through 41), and this mat process can also be applied to a display cell made up of a set of fluorescent trios as shown in FIGS. 67 and 68.

In the foregoing display unit employing the display cells 71, shown in FIG. 56, a protective resistor is inserted between each display cell and the high-voltage power source, and this arrangement can also be applied to a display unit employing the display cell 71' or a display cell shown in FIGS. 67 and 68.

A light emitting display cell 10 shown in FIGS. 67 and 68 is constructed by coating a set of fluorescent trio, i.e., a red, green and blue fluorescentlayers 14 (14R, 14G, 14B), so that they are surrounded by a carbon layer 15, on the inner surface of the front panel 11A of the glass casing 11, and by arranging three wire cathodes K (KR, KG, KB) and first grids (control electrodes) G1 (G1R), G1G, G1B) confronting the respective fluorescent layers 14R, 14G and 14B, and a common second grid (acceleration electrode) G2.

The fluorescent layers 14R, 14G and 14B are each enclosed in the separators 40, and the electron beams from the wire cathodes K project on to the corresponding fluorescent layers 14. The anode terminal 5 for supplying the anode voltage to the fluorescent layers 14 is led out through the saparator wall 40 and a space between the front panel 11A and side boards 11C of the glass casing 11, while other terminals 6 for the first grids G1 and second grid G2 are led out thrugh a space between the rear panel 11B and side boards 11C. In this light emitting display cell, the anode voltage is supplied to the fluorescent layers 14 through the anode terminal 5, fixed voltages are given to the anode and second grid G2, and the cell is activated or disactivated selectively depending on the voltage applied to the first grid G1.

Next, assembling of a large display screen made up of many units 166 described above in a matrix array will be described.

Figure 59:
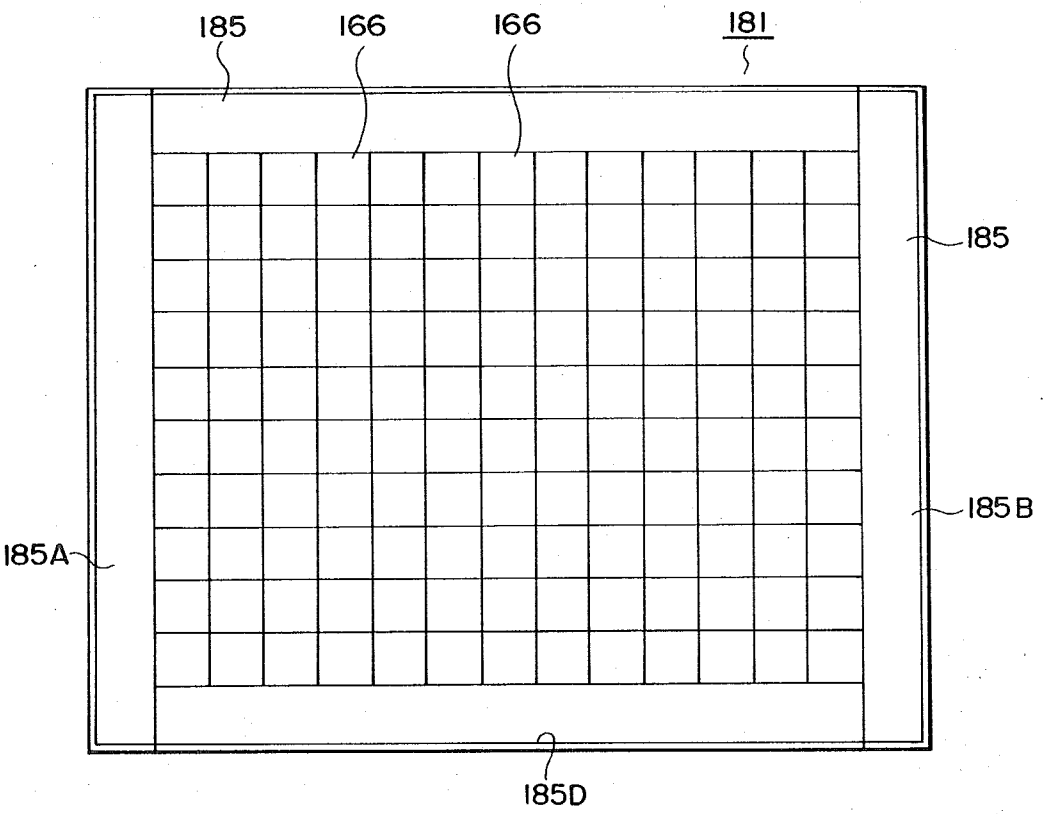
FIG. 59 is a plan view showing another example of the display apparatus according to this invention.
Figure 60:
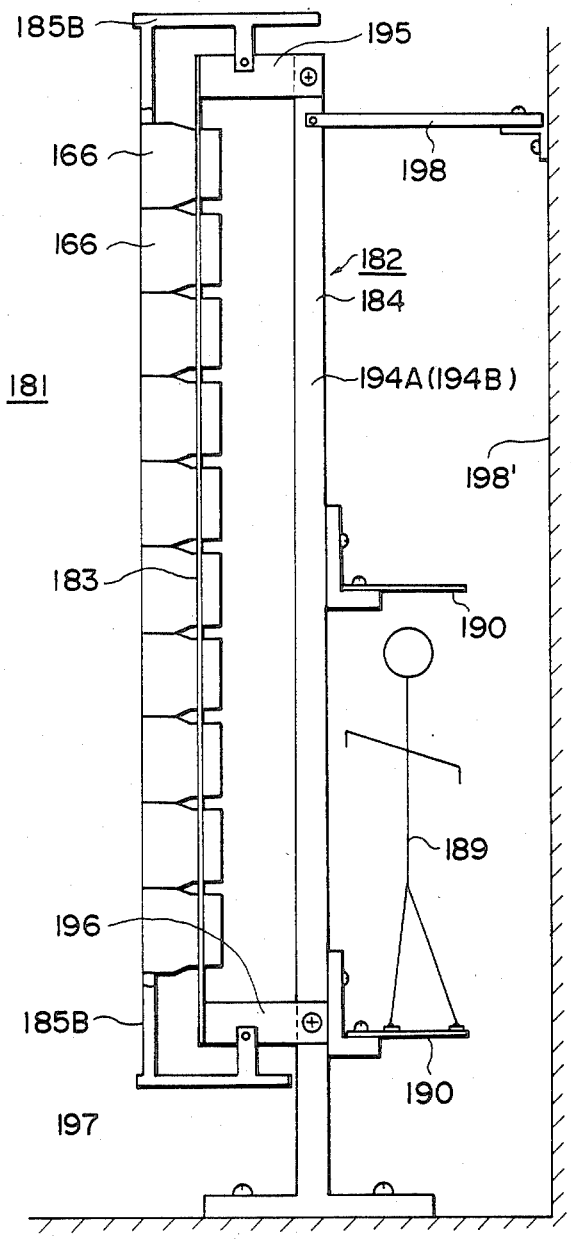
FIGS. 60 and 61 are cross-sectional view and rear view showing in detail the above display apparatus.
Figure 61:
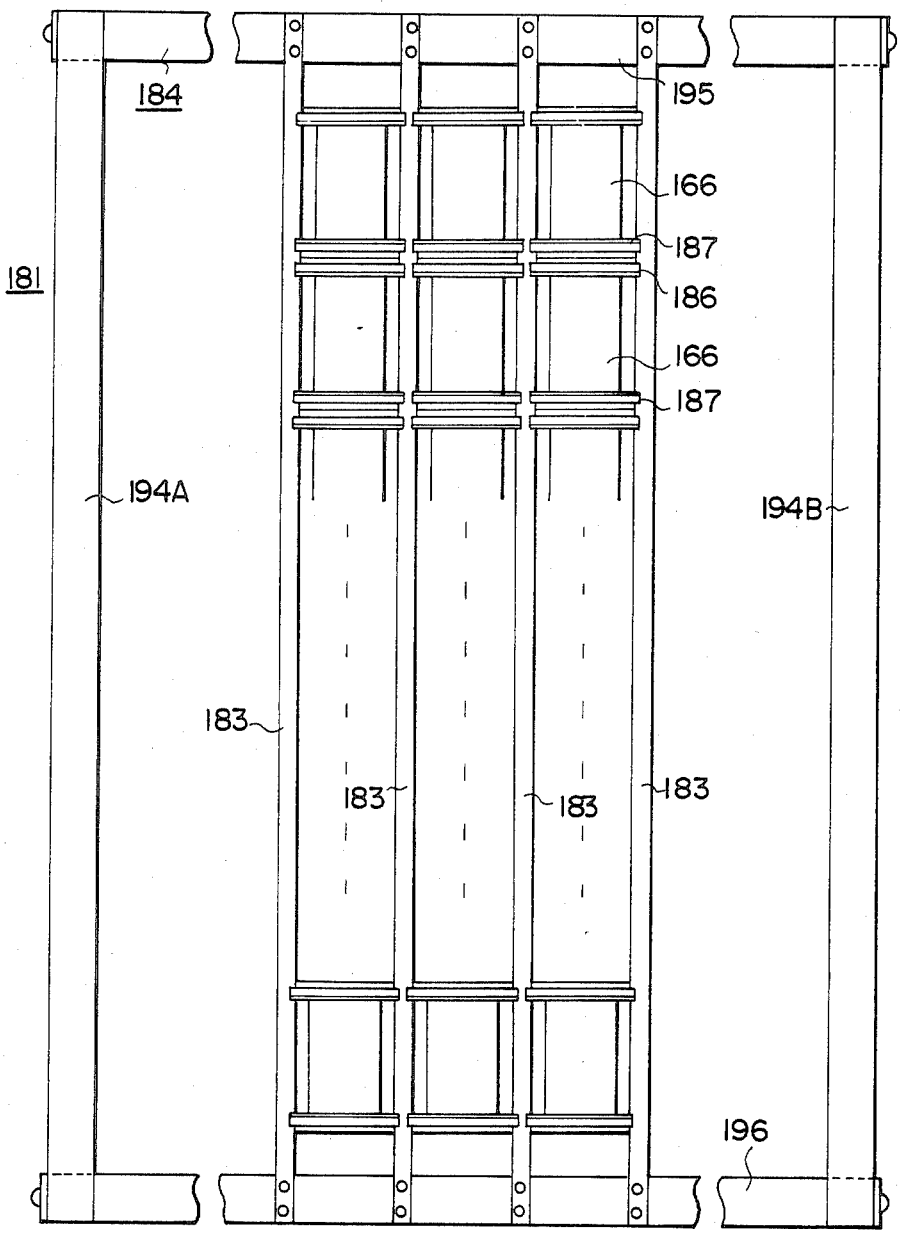

FIGS. 59, 60 and 61 show in part a general front view, enlarged cross sectional view and rear view of a large display screen 181. Each unit 166 is provided with one high-voltage power source 171, the drive circuit described in Japanese Patent Application No. 60-17129, for example, is employed, and the total structure is enclosed in a metallic cover. The unit 166 is wider in the front section **166*a* at the display screen 166A and it is tapered narrower toward the rear section 166*b* as shown in FIG. 60**.

Figure 62:
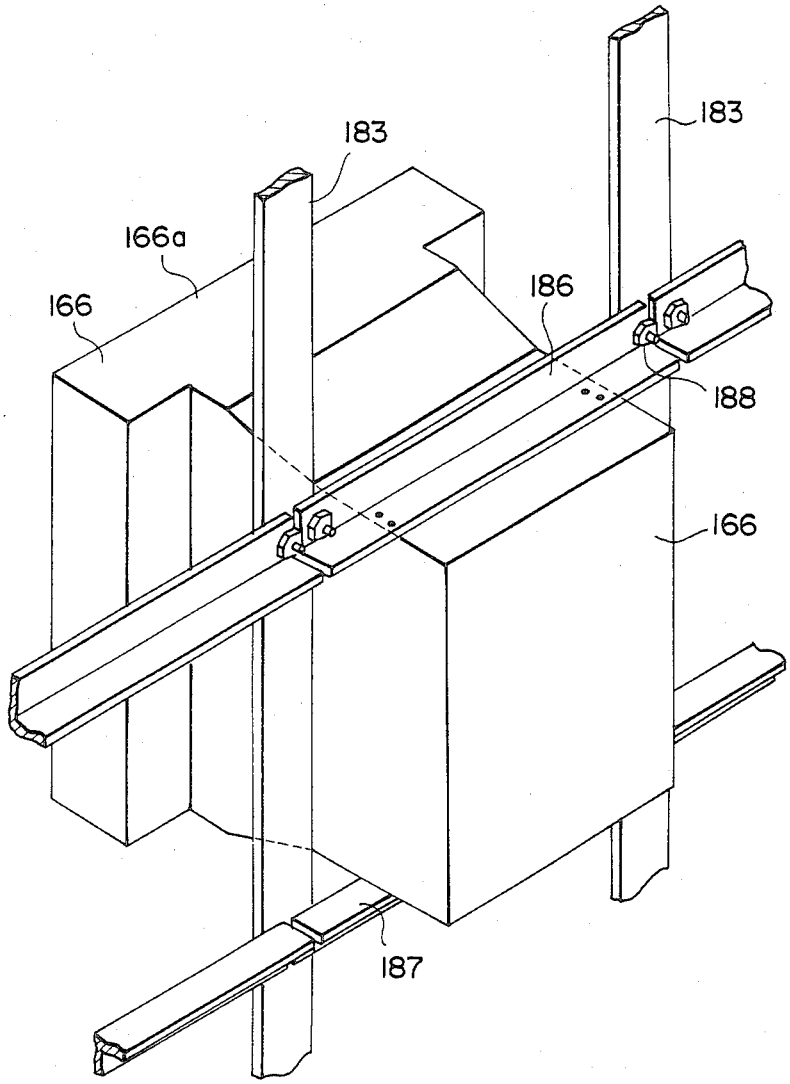
FIG. 62 is a perspective view showing the display unit mounted on the rack.
Figure 63:
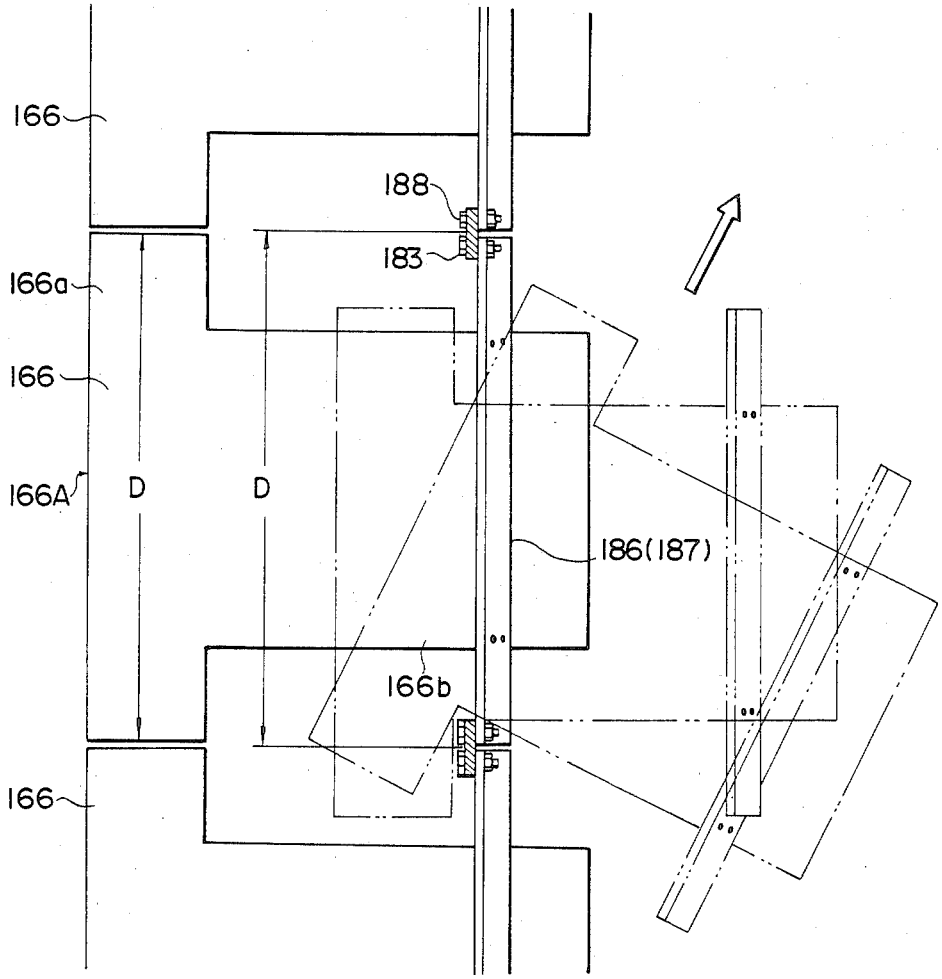
FIG. 63 is a diagram explaining the detachment of the display unit from the rack.

These units 166 of 130 in number are disposed in a matrix of 10 vertically by 13 horizontally through the fixture on rack, 183 of a construction 182, which will be described later, to construct the display screen 181. The construction 182 is made up of a rigid steel frame 184, with a number of racks 183 having a flat or T-shape cross-section extending vertically at a certain interval (flat steel racks in this embodiment) fixed on it, and the units 166 are surrounded by a decoration 185 made of stainless steel. The frame 184 is constructed by a pair of supports 194A and 194B located with a certain spacing with an upper horizontal frame 195 and lower horizontal frame 196 having a channel cross-section being fixed on it. The decoration board 185 is made of two vertical boards 185A and 185B and two horizontal boards 185C and 185D, with the horizontal boards 185C and 185D being fixed on the vertical boards 185A and 185B and with the vertical boards 185A and 185B being fixed on the upper and lower horizontal frames 195 and 196. The adjacent racks 183 have a center distance D1 set virtually equal to the width D2 of the unit 166 in its front section **166*a*. The units 166 are arranged densely with only spacing of 1–2 mm allowed between adjacent ones. When they are mounted. At the back of each unit 166, fixing tabs 186 and 187 having an L-shape cross-section are spot welded on its upper and lower surfaces. The fixing tabs 186 and 187 are placed across adjacent two racks 183 and bolted 188 at both ends from behind the racks 183, and the units 166 are secured to the construction 182 (see FIG. 62). Behind the construction 182, a scaffolding 190 for the worker 189 is provided as shown in FIG. 60. In this embodiment, a 2-stage scaffolding 190** is built for the display screen having an effective display area of about 3.5 m vertically by about 4.6 m horizontally.

The display unit 181 made up of many units 166 fixed on the construction 187 is installed in such a way that their supports 194A and 194B are fixed on the floor 197 and a fall-down preventive member 198 is fixed between the supports 194A and 194B and the wall 198', as shown in FIG. 60. Such a display screen 181 can be installed both indoors and outdoors.

Figure 65:
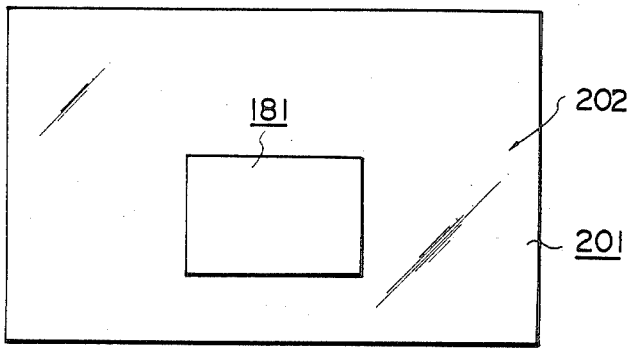
FIGS. 65 and 66 are front view and to view showing the display unit installed in the showroom.
Figure 66:
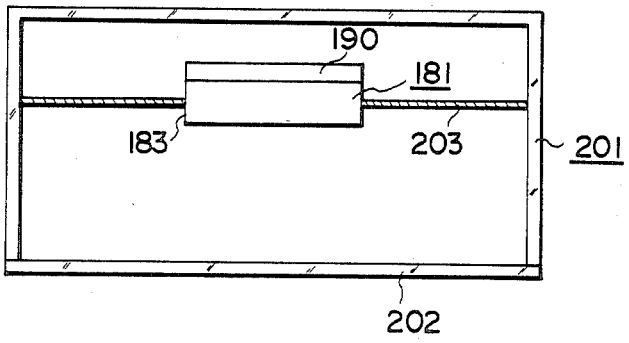

FIGS. 65 and 66 show an example of installation, in which the display screen 181 is place in a showroom 201 having a glass front wall 202. In this example, the showroom 201 has a partition wall 203 in it, and the display screen 181 is placed so that the stainless steel decoration 185 of the screen 181 comes to the opening of the wall 203.

The units 166 are mounted or demounted from behind the construction 182. When a unit 166 is removed, the bolts 188 are unscrewed, the unit 166 is moved backward while shifting it to one side as shown by the dot-dash line I, and then the unit 166 is taken out of the room between the racks 183 while slanting it as shown by the dot-dash line II. The unit 166 is mounted by reversing the above procedure.

Figure 64:
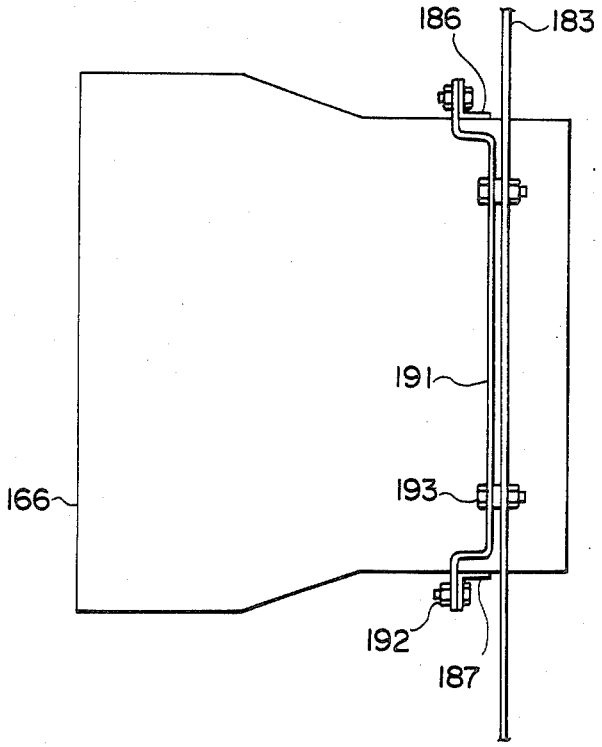
FIG. 64 is a side view showing another example of mounting the display unit on the rack.

FIG. 64 shows an example of mounting and demounting a unit 166 from the front of the construction 182. The unit 166 is provided on both sides thereof with fixing tabs 186 and 187 having an L-shape cross-section at the top and bottom, which are fixed to the ends of a shaped bar 191 using bolts 192. The bar 191 is bolted from the front to the racks 183, and the unit 166 is secured to the construction 182.

The unit 166 has a wider front **166*a* and a narrow back 166*b* and is mounted using a pair of fixing tabs 186 and 187 on the racks 183 of the construction 182, which facilitates the assembling of the units to the construction 182 and also the mounting and demounting of a unit when it needs to be repaired or replaced. Adjacent racks 183 have a distance D1 virtually equal to the front width D2 of the unit 166**, which allows layout of many units with a minimal spacing.

As described above, the inventive fluorescent display apparatus includes display cells of a first type consisting of several set of fluorescent display segments of various colors arranged in a certain order and display cells of a second type consisting of the same display segments as above, but in opposite order of arrangement. The first and second display cells are arrayed in a matrix fashion with their leads aligning alternately to form a fluorescent display unit, which reduces the area needed for the bend of the leads, particularly in the peripheral sections, whereby the display cells can be disposed closely and a better picture-quality display apparatus is accomplished.

What is claimed is:

1. In a fluorescent display screen apparatus, a display unit comprising:

a first display cell consisting of a plurality of sets of fluorescent display segments of different colors arranged in a certain order; and outer leads arranged on one side, a second display cell consisting of a plurality of sets of fluorescent display segments of different colors same in number and color as of said first display cell, but in opposite order of arrangement of colors to said first display cell, and outer leads arranged on the same side as of said first display cell, said first and second display cells being arrayed to construct said display unit such that their outer leads confront each other and align alternately, whereby said display screen apparatus being made up of a plurality of said display units in a matrix array.

2. In an apparatus according to claim 1, a pair of said first display cells are combined into an unitary structure by a first common driver circuit, and a pair of said second display cells are combined into an unitary structure by a second common driver circuit, whereby to constitute a first and a second display tube blocks, respectively.

3. In an apparatus according to claim 2, said first and second display tube blocks are arrayed and fixed on an unit panel which has a plurality of windows corresponding to said display segments such that their outer leads confront each other and align alternately.

4. In an apparatus according to claim 1, each said display unit is associated with a power supply.

5. In an apparatus according to claim 4, a protective resister is connected between said power supply and each said display cell.

6. In an apparatus according to claim 1, said display cells are rendered on a surface anti-reflective process.

* * * * *